US008246489B2

(12) United States Patent
Yamamoto

(10) Patent No.: US 8,246,489 B2
(45) Date of Patent: Aug. 21, 2012

(54) GOLF CLUB HEAD

(75) Inventor: Akio Yamamoto, Kobe (JP)

(73) Assignee: SRI Sports Limited, Kobe-Shi, Hyogo (JP)

( * ) Notice: Subject to any disclaimer, the term of this patent is extended or adjusted under 35 U.S.C. 154(b) by 276 days.

(21) Appl. No.: 12/762,636

(22) Filed: Apr. 19, 2010

(65) Prior Publication Data

US 2010/0273574 A1 Oct. 28, 2010

(30) Foreign Application Priority Data

Apr. 22, 2009 (JP) ..... 2009-103946

(51) Int. Cl.
*A63B 53/04* (2006.01)

(52) U.S. Cl. ..... 473/346

(58) Field of Classification Search ..... 473/346
See application file for complete search history.

(56) References Cited

U.S. PATENT DOCUMENTS

| | | | | |
|---|---|---|---|---|
| 7,273,423 | B2 * | 9/2007 | Imamoto | 473/332 |
| 2005/0221913 | A1 | 10/2005 | Kusumoto | |
| 2006/0172818 | A1 * | 8/2006 | Yamamoto | 473/345 |
| 2008/0176674 | A1 | 7/2008 | Horacek et al. | |

FOREIGN PATENT DOCUMENTS

| | | | |
|---|---|---|---|
| JP | 2003-102877 | A | 4/2003 |
| JP | 2005-278950 | A | 10/2005 |
| JP | 2006-204604 | A | 8/2006 |

OTHER PUBLICATIONS

Japanese Office Action dated Apr. 26, 2011, for Application No. 2009-103946.
Office Action dated Jun. 21, 2011 for corresponding Japanese Application No. 2009-103946.

* cited by examiner

*Primary Examiner* — Michael Dennis
(74) *Attorney, Agent, or Firm* — Birch, Stewart, Kolasch & Birch, LLP

(57) ABSTRACT

A head 2 is provided with a face 4, a crown 6, and a sole 8. The head 2 is hollow. At least a part of an inner surface of the head 2 is a metal inner surface Kn. At least one rib 20 made of a metal is provided on the metal inner surface Kn. The at least one rib 20 is a partial weld rib obtained by carrying out partial welding between the rib 20 and the metal inner surface Kn. A welded portion and an unwelded portion coexist in a longitudinal direction of the partial weld rib 20 between the metal inner surface Kn and the partial weld rib 20. Preferably, the partial welding is carried out between a side surface 24 of the partial weld rib 20 and the metal inner surface Kn. Preferably, a weld bead Bd is present on a place on which the partial welding is carried out.

20 Claims, 23 Drawing Sheets

GOLF CLUB HEAD

This application claims priority on Patent Application No. 2009-103946 filed in JAPAN on Apr. 22, 2009, the entire contents of which are hereby incorporated by reference.

BACKGROUND OF THE INVENTION

1. Field of the Invention

The present invention relates to a hollow golf club head.

2. Description of the Related Art

A hollow golf club head has been known. The hollow structure increases a head volume and a moment of inertia. For example, a so-called wood type, hybrid type, and utility type heads are usually hollow.

The volume of a hollow part is increased and the thickness of the head is thinned with the increase in size of the head. When the hollow part is great, a hitting sound is loud. Since the vibration of the head is great when the thickness is thin, the hitting sound is loud. The head increased in size causes a loud hitting sound.

Golf club heads considering a hitting sound have been proposed. A golf club head is disclosed, which has an inner surface having a rib provided thereon in order to obtain a good hitting sound. Japanese Patent Application Laid-Open No. 2006-204604 (U.S. Patent No. 2006/172818) discloses a curved rib extending to a heel side edge part of a sole from a toe side edge part thereof. Japanese Patent Application Laid-Open No. 2003-102877 discloses a rib provided in an abdominal part producing an out-of-plane secondary bending vibration in a sole part.

SUMMARY OF THE INVENTION

As a forming method of a rib, the following (method 1) and (method 2) are considered.

(Rib Forming Method 1): A method for integrally forming at least a part of a head body (sole or the like) with a rib.

(Rib Forming Method 2): A method for respectively separately forming a head body and a rib and then bonding them.

On the other hand, as a manufacturing method of a head body, for example, the following (method A) and (method B) are considered.

(Head Manufacturing Method A): A method for pressing and/or forging a cut material (rolling material or the like) to produce a plurality of head members and bonding them.

(Head Manufacturing Method B): A method for welding a plurality of cast members.

Casting enables formation of a comparatively complicated shape. When a head body on which a rib is provided is manufactured by casting, the rib and the head body are considered to be integrally formed by the casting in many cases in respect of simplification of a manufacturing process. Therefore, for example, when the head manufacturing method B is employed, the rib forming method 1 is considered to be used in many cases. However, a shape and position or the like of the rib may complicate the integral formation of the rib and the head body by the casting. In this case, the rib forming method 2 can be employed.

On the other hand, when the head body on which the rib is provided is manufactured by pressing and/or forging, it is usually difficult to integrally form the rib and the head body. Therefore, for example, when the head manufacturing method A is employed, the rib forming method 2 is used. Also when the head body on which the rib is provided is manufactured by the forging, it may be difficult to integrally form the rib and the head body. Also in this case, the rib forming method 2 is preferred.

When the head body and the rib are integrally formed, a shape of a mold is complicated. In this case, the manufacture cost of the mold may be increased, and the durability of the mold may be reduced. These increase the manufacture cost of the head. In respect of avoiding the increase of the manufacture cost, the rib forming method 2 can be employed.

In respect of the durability, when the rib forming method 2 is employed, the rib and the head body are preferably welded to each other. Bonding other than the welding is apt to cause an insufficient bonding strength.

Impact in hitting a ball is great. In respect of the bonding strength of the rib, it is considered that the area of welding portions between the rib and the head body is preferably increased as much as possible. Therefore, it is considered that the rib is preferably welded linearly over the entire longitudinal direction of the rib along a boundary between the rib and the head body when the rib and the head body are welded to each other.

However, it was found that a new problem occurs when welding is carried out over the entire longitudinal direction of the rib. Specifically, it was found that this case is apt to cause the reduction in rebound performance and the reduction in hitting feeling.

It is an object of the present invention to provide a golf club head which can suppress the reduction in rebound performance and hitting feeling when a rib and a head body are welded to each other.

A golf club head of the present invention includes a face, a sole, and a crown. The head is hollow. At least a part of an inner surface of the head is a metal inner surface made of a metal. At least one rib made of a metal is provided on the metal inner surface. The at least one rib is a partial weld rib obtained by carrying out partial welding between the at least one rib and the metal inner surface. A welded portion and an unwelded portion coexist in a longitudinal direction of the partial weld rib between the metal inner surface and the partial weld rib.

Preferably, the partial welding is carried out between a side surface of the partial weld rib and the metal inner surface. Preferably, the partial welding is carried out on only one side surface of both side surfaces of the partial weld rib.

Preferably, an extending direction of the partial weld rib is inclined or orthogonalized with respect to a face-back direction of the head. Preferably, the partial welding is carried out on only a side surface of a face side of both side surfaces of the partial weld rib.

Preferably, a weld bead is formed by the partial welding. Preferably, a rib height HR is equal to or greater than 2 mm, a height HB of the weld bead is equal to or greater than 2 mm, and a length LB of the weld bead is equal to or greater than 2 mm in at least one welded place.

Preferably, when a traverse width of an end part of the weld bead is defined as T1 (mm) and a minimum traverse width is defined as T2 (mm) in a section of a widthwise central surface PLc of the weld bead, a ratio (T2/T1) is 0.5 or greater and 0.95 or less.

Preferably, a plurality of partial weldings are carried out in the single partial weld rib. Preferably, a distance c1 between the adjacent partial weldings is 10 mm or greater and 25 mm or less.

Preferably, three or more partial weldings are carried out in the single partial weld rib. Preferably, a difference (Cmax−Cmin) between the maximum value Cmax (mm) and the minimum value Cmin (mm) of a distance c1 between the adjacent partial weldings is equal to or greater than 1 mm in the partial weld rib.

Preferably, when a total value of a bead maximum width W1 of the partial welding is defined as TW1 (mm), and a real length of a root of the rib is defined as RL1 (mm), a ratio (TW1/RL1) is equal to or less than 0.40.

The partial weld rib may be curved.

Preferably, at least one of a toe side end and a heel side end of the partial weld rib extends to the crown.

Preferably, a length Lc of the partial weld rib on the crown is equal to or less than 10 mm.

The head may have a side. A toe side and a heel side of the partial weld rib may be terminated at the side.

Preferably, weld beads are formed by the partial welding. The weld beads may be present on a back side and a face side of the partial weld rib.

Preferably, a position in a longitudinal direction of the rib of the weld bead of the face side is different from that of the weld bead of the back side in at least two weld beads of the weld beads.

The partial weld rib may be present on only the inner surface of the sole, and may not be present on the inner surface of the crown or the inner surface of the side.

Preferably, the number of the partial weld ribs is plural.

Preferably, the partial weld ribs and nonpartial weld ribs coexist, and preferably, when the number of the partial weld ribs is defined as N1 and the number of the nonpartial weld ribs is defined as N2, [N1/(N1+N2)] is equal to or greater than ½.

Preferably, a rib height HR of the partial weld rib is equal to or less than 8 mm. Preferably, a bead height HB of the weld bead is equal to or less than 8 mm. Preferably, a length LB of the weld bead is equal to or less 8 mm.

Preferably, a weight Mr of the partial weld rib is 1.0 g or greater and 5.0 g or less.

Preferably, a ratio (Mr/Mh) of a weight Mr of the partial weld rib to a weight Mh of the head is 0.008 or greater and 0.025 or less.

Preferably, an average value of a rib width BR of the partial weld rib is 0.5 mm or greater and 1.5 mm or less.

Preferably, a ratio (Wr/Wc) of a length Wr of the partial weld rib to a length Wc of the head is 0.80 or greater and 0.98 or less.

The rib can improve the hitting sound. The reduction in rebound performance and hitting feeling caused by the welding can be suppressed by partially welding the rib and the head body to each other.

DESCRIPTION OF THE PREFERRED EMBODIMENTS

The present invention will be described below in detail based on preferred embodiments with reference to the drawings.

Figure 2:
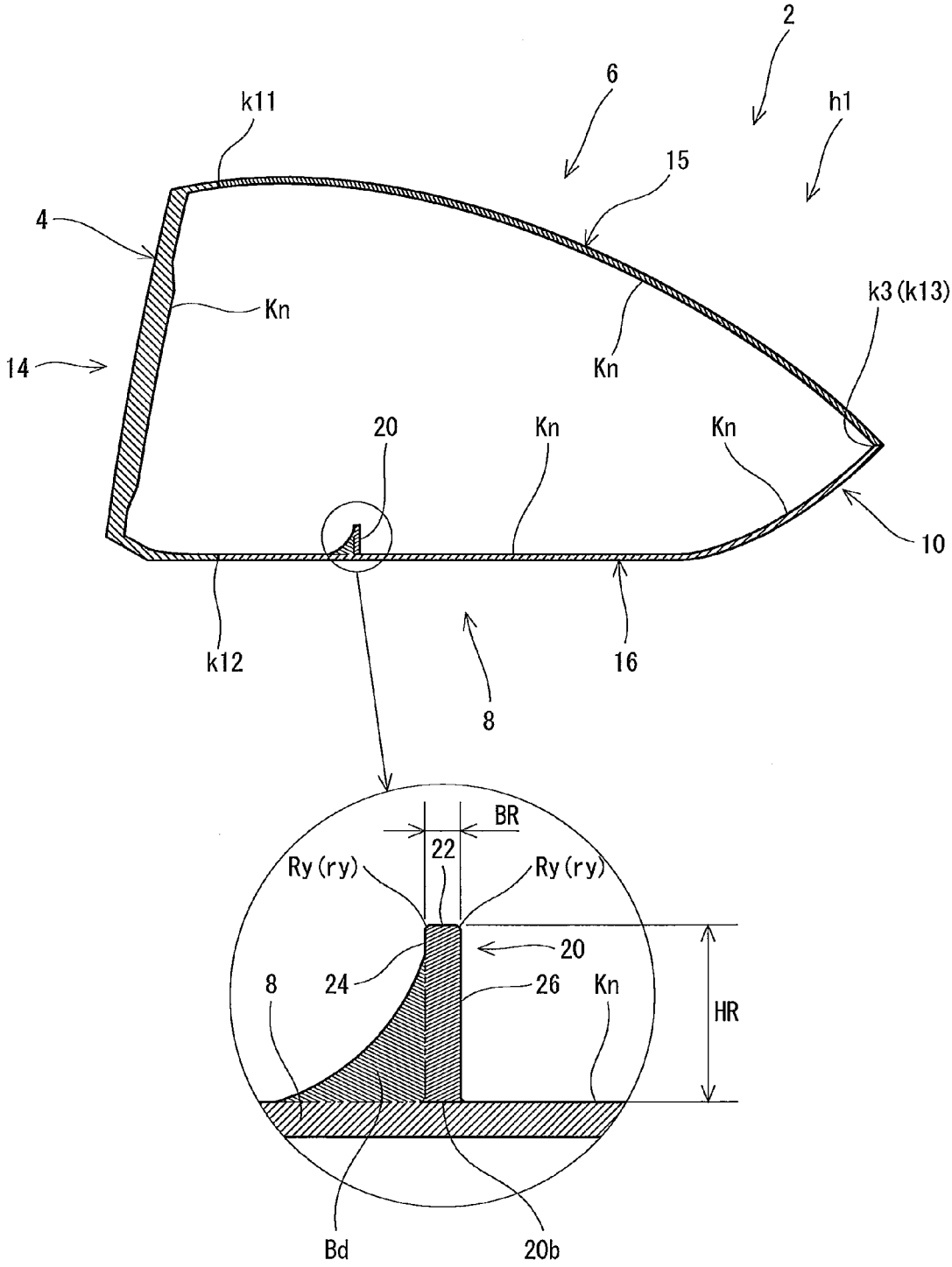
FIG. 2 is a sectional view taken along a line II-II of FIG. 1.
Figure 4:
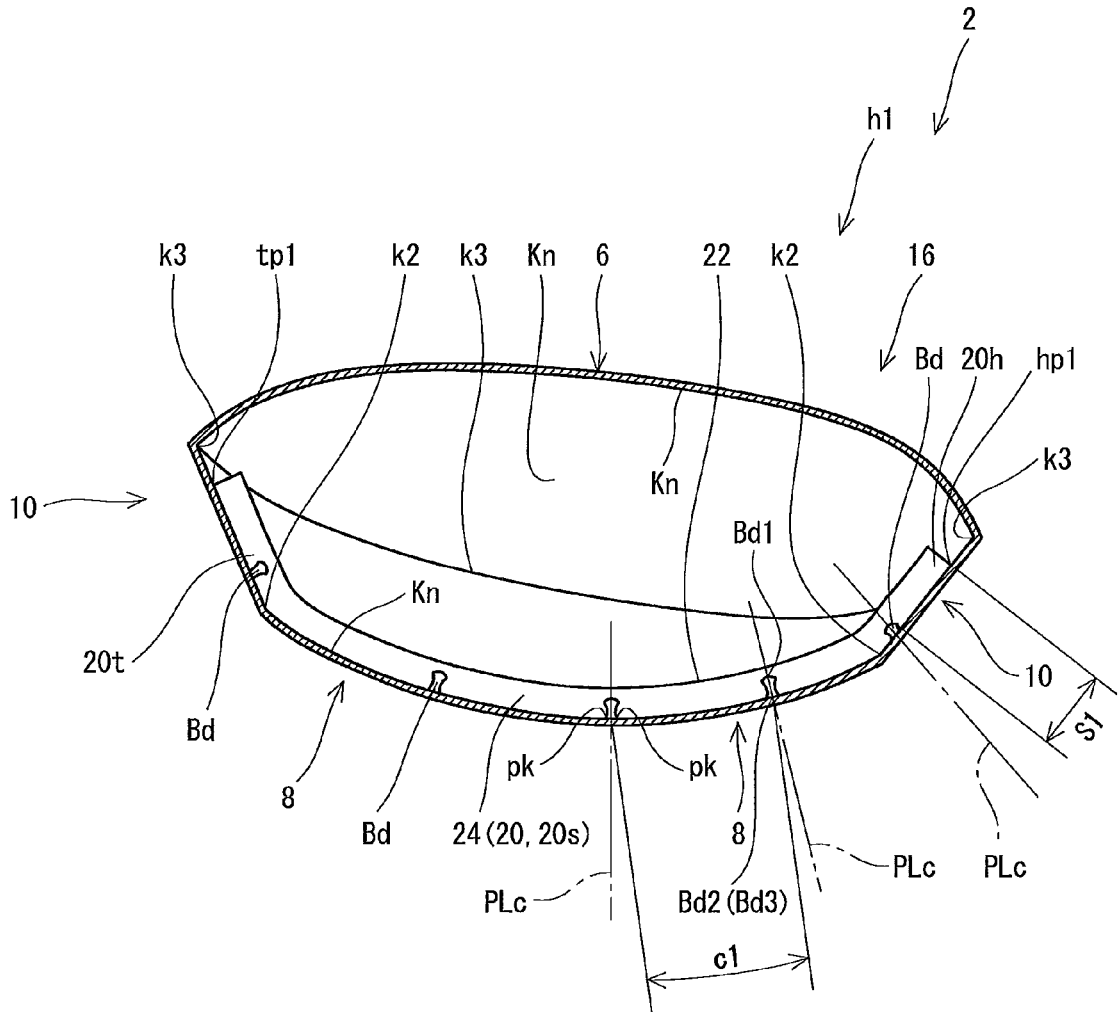
FIG. 4 is a sectional view taken along a line IV-IV of FIG. 1.

A head 2 has a face 4, a crown 6, a sole 8, a side 10, and a hosel 12. The crown 6 extends to the back side of the head from the upper edge of the face 4. The sole 8 extends to the back side of the head from the lower edge of the face 4. The side 10 extends between the crown 6 and the sole 8. The side 10 extends to a heel side via a back side from a toe side. As shown in FIGS. 2 and 4, the inside of the head 2 is hollow. The head 2 is hollow. The head 2 is a so-called wood type golf club head. The type of the head 2 is not restricted, and a utility type head, a hybrid type head, an iron type head, and a putter type head are exemplified.

As shown in FIG. 4, a boundary k2 between the sole 8 and the side 10 is present on the inner surface of the head 2. Furthermore, a boundary k3 between the side 10 and the crown 6 is present on the inner surface of the head 2.

The head 2 has a head body h1, a partial weld rib 20, and a weld bead Bd. The head body h1 has a face member 14, a crown member 15, a sole member 16, and a neck member, which are bonded by welding. The face member 14, the crown member 15, and the sole member 16 are respectively made of a titanium alloy. The neck member is made of pure titanium. A boundary k11 between the face member 14 and the crown member 15 is shown in FIG. 2. A boundary k12 between the crown member 15 and the face member 14 is shown in FIG. 2. A boundary k13 between the crown member 15 and the sole member 16 is shown in FIG. 2.

The face member 14 constitutes the entire face 4. Furthermore, the face member 14 constitutes a part of the crown 6, a part of the sole 8, and a part of the side 10. The face member 14 is approximately dish-shaped (cup-shaped). The face member 14 may be referred to as a cup face.

The crown member 15 constitutes a part of the crown 6. The crown 6 is constituted by the face member 14 and the crown member 15.

The sole member 16 constitutes a part of the sole 8. The sole 8 is constituted by the sole member 16 and the face member 14.

Figure 1:
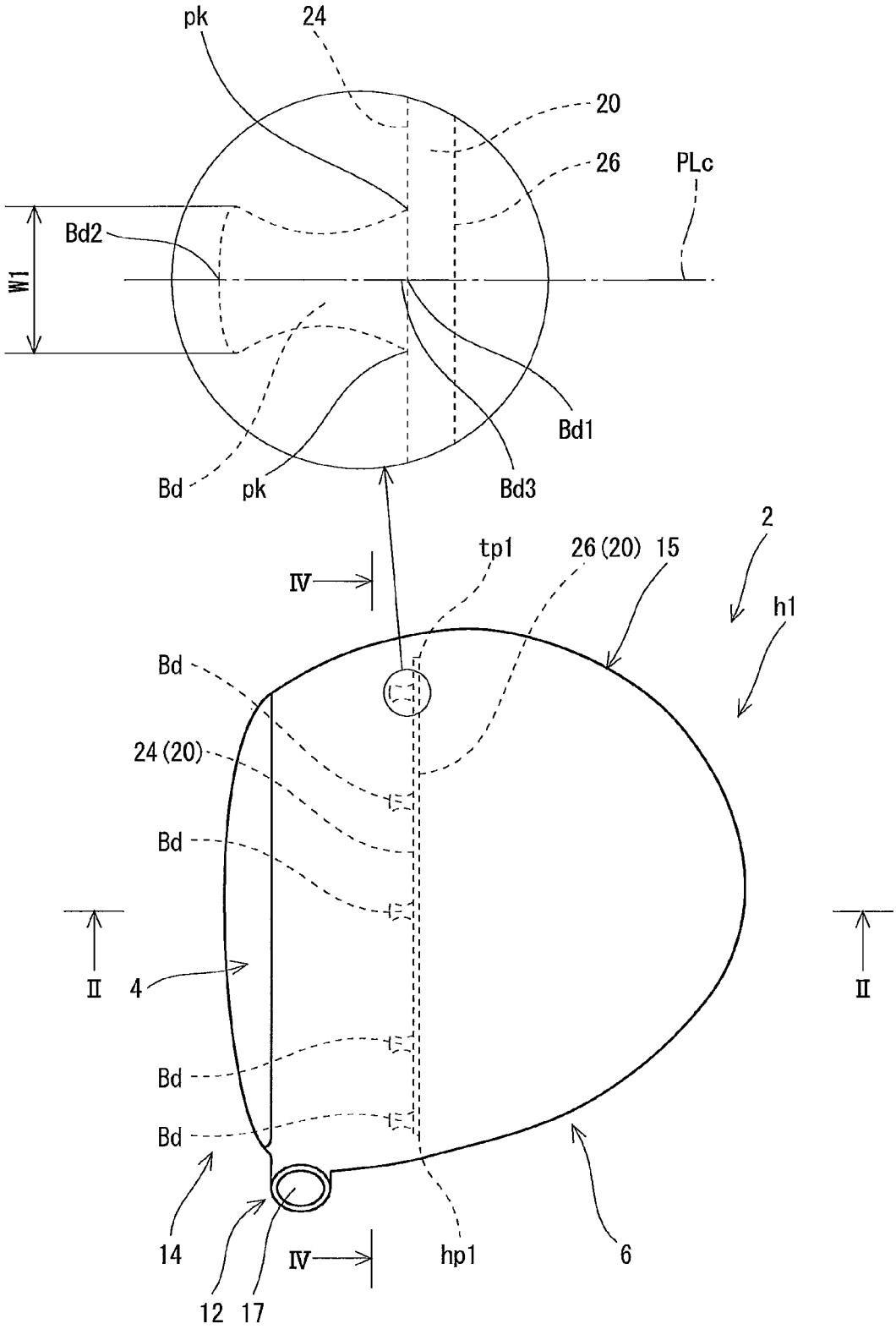
FIG. 1 is a plan view of a golf club head according to a first embodiment of the present invention, as viewed from a crown side.

The hosel 12 is constituted by the neck member. As shown in FIG. 1, the hosel 12 has a hole 17 to which a shaft is mounted. The shaft which is not shown is inserted into the hole 17. The hole 17 has a center axial line Z1, which is not shown. The center axial line Z1 generally conforms to a shaft axial line of a golf club provided with the head 2.

In the present application, a standard vertical plane, a face-back direction, and a toe-heel direction are defined. A standard condition denotes a state that the center axial line Z1 is contained in a plane P1 perpendicular to a horizontal plane H and the head is placed on the horizontal plane H at a prescribed lie angle and real loft angle. The standard vertical plane denotes the plane P1.

In the present application, the toe-heel direction is a direction of line of intersection between the standard vertical plane and the horizontal plane H.

In the present application, the face-back direction is a direction perpendicular to the toe-heel direction and parallel to the horizontal plane H.

The head 2 has an inner surface on which a rib 20 is provided. As shown in FIG. 4, the rib 20 continuously extends to the side 10 of the heel side via the sole 8 from the side 10 of the toe side. More specifically, the rib 20 has a sole disposing part 20*s* located on the inner surface of the sole 8, a toe side part 20*t* located on the side 10 of the toe side, and a heel side part 20*h* located on the side 10 of the heel side. The toe side part 20*t* is located on the toe side relative to the heel side part 20*h*. The toe side part 20*t* is located on the toe side relative to the sole disposing part 20*s*. The heel side part 20*h* is located on the heel side relative to the sole disposing part 20*s*.

A toe side end point tp1 of the rib 20 is an end point of the toe side part 20*t*. A heel side end point hp1 of the rib 20 is an end point of the heel side part 20*h*.

The rib 20 is continuously provided without interruption. The rib 20 is continuously provided toward the end point hp1 from the endpoint tp1. The toe side part 20*t*, the sole disposing part 20*s*, and the heel side part 20*h* are continuously connected. More specifically, the toe side part 20*t*, the sole disposing part 20*s*, and the heel side part 20*h* are continuously provided.

The number of the ribs 20 is one. The rib 20 extends in one stripe shape. As shown in FIG. 1, the rib 20 extends linearly. When the rib 20 is projected on the horizontal plane H in the head 2 of the standard condition, a projected image Tr of the rib 20 is approximately straight. A central line (not shown) in a width direction of an upper surface 22 of the rib 20 is a straight line. The width of the upper surface 22 of the rib 20 is constant. The upper surface 22 of the rib 20 extends straight. A side surface 24 of the face side of the rib 20 is a plane. A side surface 26 of the back side of the rib 20 is a plane. The extending direction of the rib 20 is not restricted. The rib 20 may be curved.

The sole 8 vibrates in hitting a ball. The vibration of the sole 8 contributes to a hitting sound. The rib 20 enhances the rigidity of the sole 8. The rib 20 increases the frequency of the hitting sound. The rib 20 contributes to improvement in the hitting sound.

The side 10 vibrates in hitting a ball. The vibration of the side 10 contributes to the hitting sound. The rib 20 enhances the rigidity of the side 10. The rib 20 increases the frequency of the hitting sound. The rib 20 contributes to improvement in the hitting sound.

In the embodiment, the single rib 20 reinforces the sole 8, the side 10 of the heel side, and the side 10 of the toe side. The constitution can enhance the improvement effect of the hitting sound. The vibration of the head in hitting a ball includes a vibration mode in which a central part of the sole 8 is an antinode and the side 10 is a node. The rib 20 increases the frequency of a sound resulting from the vibration mode effectively. The rib 20 can increase the frequency of the hitting sound effectively.

Since the single rib 20 reinforces the sole 8, the side 10 of the heel side, and the side 10 of the toe side, the improvement of the hitting sound can be attained while the weight of the rib 20 can be suppressed.

The rib 20 is provided on a metal inner surface Kn of the head 2. In the embodiment, the entire inner surface of the head 2 is the metal inner surfaces Kn. The metal inner surface Kn may be a part of the inner surface of the head 2. For example, when the crown member 15 is a nonmetal (CFRP or the like), a part of the inner surface of the head 2 is the metal inner surface Kn. The CFRP means carbon fiber reinforced plastic.

The rib 20 is made of a metal. The rib 20 is made of a metal which can be welded to the metal inner surface Kn.

The rib 20 is partially welded to the metal inner surfaces Kn. In the embodiment of FIG. 1, the number of welded places is five. The number of the welded places may be one, or equal to or greater than two. A part of the rib 20 in the longitudinal direction is welded. Not the entire rib 20 in the longitudinal direction is welded. In the present application, the rib 20 having a part welded in the longitudinal direction is also referred to as a partial weld rib.

A weld bead Bd is present at the welded place. The weld bead Bd attains welding. The weld bead Bd may not be present. In respect of enhancing a bonding strength, it is preferable that the weld bead Bd is present. The weld bead Bd may be a solidified body A obtained by melting both members (the sole 8 and the rib 20 in the embodiment) to be welded and then solidifying both the members. The weld bead Bd may be a solidified body B obtained by melting a filler metal (a weld rod or the like) and then solidifying the filler metal. Alternatively, the weld bead Bd may be a mixture of the solidified body A and the solidified body B. In respect of the bonding strength, it is preferable that the weld bead Bd contains the solidified body B.

As in the embodiment, the number of the partial weld ribs 20 may be one, or plural. Unlike the embodiment, a rib other than the partial weld rib 20 may be provided. For example, the entire rib (entire weld rib) in the longitudinal direction may be welded. For example, a rib integrally formed with the metal inner surface Kn may be present. As a method for the integral forming, casting and forging are exemplified.

In the rib 20 of the embodiment, a portion in which the weld bead Bd is present is a welded portion. In the embodiment, a portion in which the weld bead Bd is not present is an unwelded portion. The weld beads Bd are dottedly present.

The plurality of weld beads Bd are provided at intervals. The length (the total length of lengths of the plurality of weld beads Bd) of the weld beads Bd in a direction along the rib 20 is shorter than the length of the rib 20. More specifically, a ratio (TW1/RL1) to be described later is less than 1.0. Thus, welding of the rib 20 and the head body (sole 8) is partial welding.

The partial weld rib 20 is a member (rib member) formed separately from the head body. The rib member is a long plate member. The partial weld rib 20 is fixed to the metal inner surface Kn by partially welding the rib member.

In the unwelded portion, a bottom surface 20*b* (see FIG. 3) of the rib 20 may be bonded to the metal inner surface Kn, or may not be bonded to the metal inner surface Kn. In the unwelded portion, the bottom surface 20*b* of the rib 20 is brought into contact with the metal inner surface Kn without being bonded to the metal inner surface Kn. In the unwelded portion, the bottom surface 20*b* may be separated from the metal inner surface Kn.

In the welded portion, the bottom surface 20*b* of the rib 20 may not be bonded (welded) to the metal inner surface Kn, or may be bonded (welded) to the metal inner surface Kn. In the embodiment, the bottom surface 20*b* of the rib 20 is not welded to the metal inner surface Kn.

Figure 3:
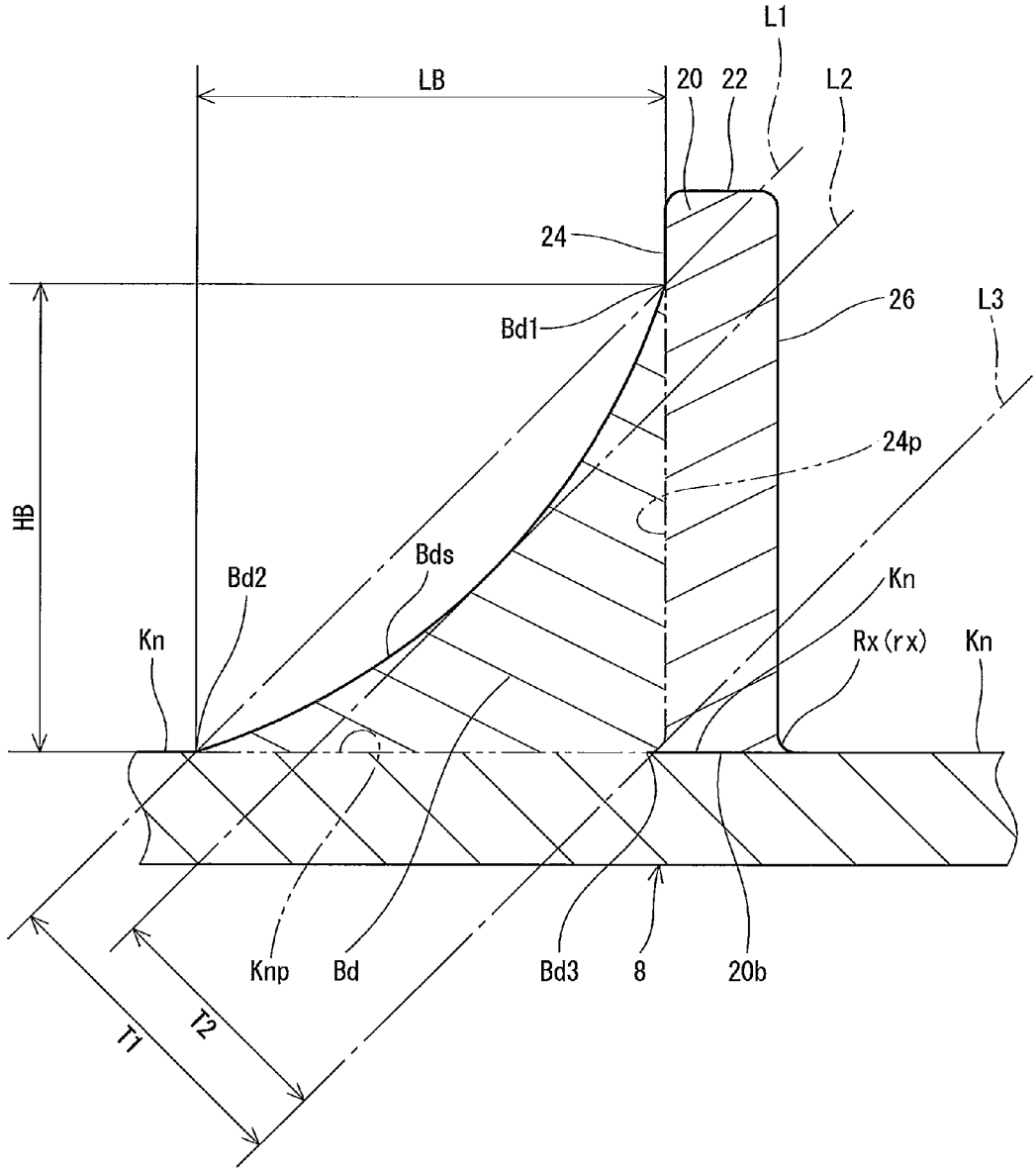
FIG. 3 is a sectional view obtained by further expanding an enlarged part of FIG. 2.

In the embodiment, the side surface 24 of the face side of the rib 20 is welded to the metal inner surface Kn (see FIG. 3). A side surface 24*p* before welding and a metal inner surface Knp before welding are shown by a dashed-two dotted line in FIG. 3. FIGS. 2 and 3 are separately hatched with the dashed-two dotted line as a boundary. However, in fact, the boundary of the dashed-two dotted line is not a straight line as shown in FIG. 2 and FIG. 3. At least apart of the boundary of the dashed-two dotted line disappears with melting caused by welding. Alternatively, the boundary of the dashed-two dotted line may be irregularly curved with melting caused by welding.

In welding which uses no weld bead Bd, for example, the bottom surface 20*b* of the rib 20 (see FIG. 3) is welded to the metal inner surface Kn.

In the embodiment, the side surface 26 of the back side of the rib 20 is not welded to the metal inner surface Kn (see FIG. 1 to FIG. 3). The weld bead Bd is present on only the face side of the rib 20. The weld bead Bd is not present on the back side of the rib 20. Thus, in the embodiment, partial welding is carried out only on one side surface of both the side surfaces of the rib 20.

Figure 6:
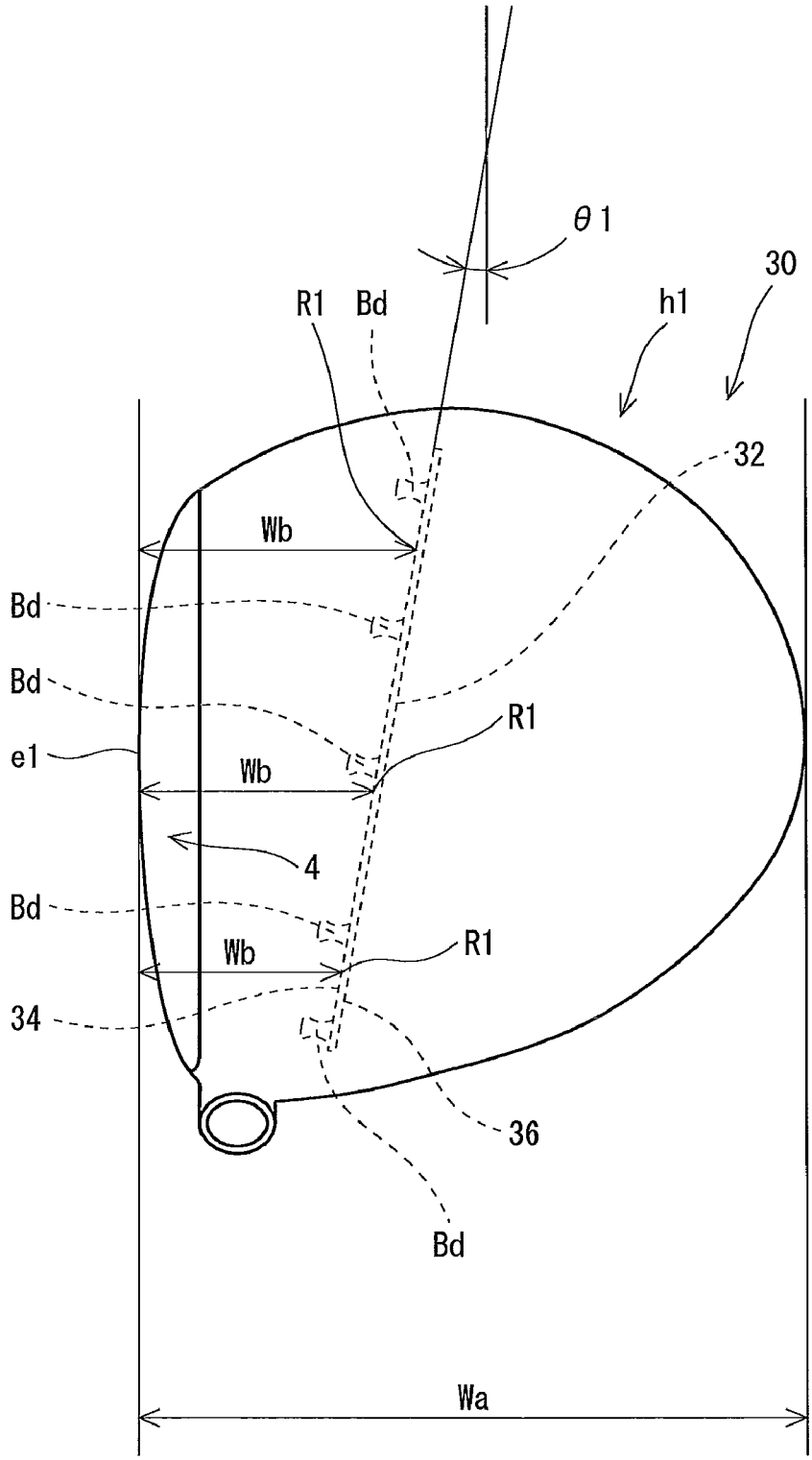
FIG. 6 is a plan view of a golf club head according to a second embodiment of the present invention, as viewed from a crown side.

FIG. 6 is a plan view of a golf club head 30 according to a second embodiment of the present invention, as viewed from a crown side. In the head 30, the extending direction of a rib 32 is inclined with respect to a toe-heel direction. The inclination angle is shown by θ1 in FIG. 6. Thus, the partial weld rib 32 may be inclined with respect to the toe-heel direction.

The rib 32 extends straight as in the rib 20. On the other hand, the partial weld rib of the present invention may be curved. The extending direction and extending shape of the partial weld rib are not restricted.

The sole vibrates in hitting a ball. The vibration of the sole contributes to a hitting sound. The rib 32 enhances the rigidity of the sole. The rib 32 increases the frequency of the hitting sound. The rib 32 contributes to improvement in the hitting sound.

The side vibrates in hitting a ball. The vibration of the side contributes to the hitting sound. The rib 32 enhances the rigidity of the side. The rib 32 increases the frequency of the hitting sound. The rib 32 contributes to improvement in the hitting sound.

In the embodiment, the single rib 32 reinforces the sole, the side of the heel side and the side of the toe side. The constitution can enhance the improvement effect of the hitting sound. The vibration of the head in hitting a ball includes a vibration mode in which a central part of the sole is an antinode and the side is a node. The rib 32 effectively increases the frequency of a sound resulting from the vibration mode. The rib 32 can effectively increase the frequency of the hitting sound.

Since the single rib 32 reinforces the sole, the side of the heel side and the side of the toe side, the improvement of the hitting sound can be attained while the weight of the rib 32 can be suppressed.

The rib 32 is partially welded to the metal inner surfaces Kn. In the embodiment of FIG. 6, the number of welded places is five. The number of the welded places may be one, or equal to or greater than two. A part of the rib 32 in the longitudinal direction is welded. Not the entire rib 32 in the longitudinal direction is welded. The rib 32 is a partial weld rib.

A weld bead Bd is present at the welded place. The weld bead Bd attains welding.

In the rib 32 of the embodiment, a portion in which the weld bead Bd is present is a welded portion. In the embodiment, a portion in which the weld bead Bd is not present is an unwelded portion. The weld beads Bd are present in a substantially dot-like shape. The plurality of weld beads Bd are provided at intervals. The total length of the weld beads Bd (the total length of lengths of the plurality of weld beads Bd) in a direction along the rib 32 is shorter than the length of the rib 32. Thus, welding of the rib 32 and the head body (sole) is partial welding.

The partial weld rib 32 is a member (rib member) formed separately from the head body. The rib member is a long plate member. The partial weld rib 32 is fixed to the metal inner surface Kn by partially welding the rib member.

In the embodiment, a side surface 34 of the face side of the rib 32 is welded to the metal inner surface Kn. In the embodiment, a side surface 36 of the back side of the rib 32 is not welded to the metal inner surface Kn. The weld bead Bd is present on only the face side of the rib 32. The weld bead Bd is not present on the back side of the rib 32. Thus, in the embodiment, partial welding is carried out on only one side surface of both the side surfaces of the rib 32.

Figure 7:
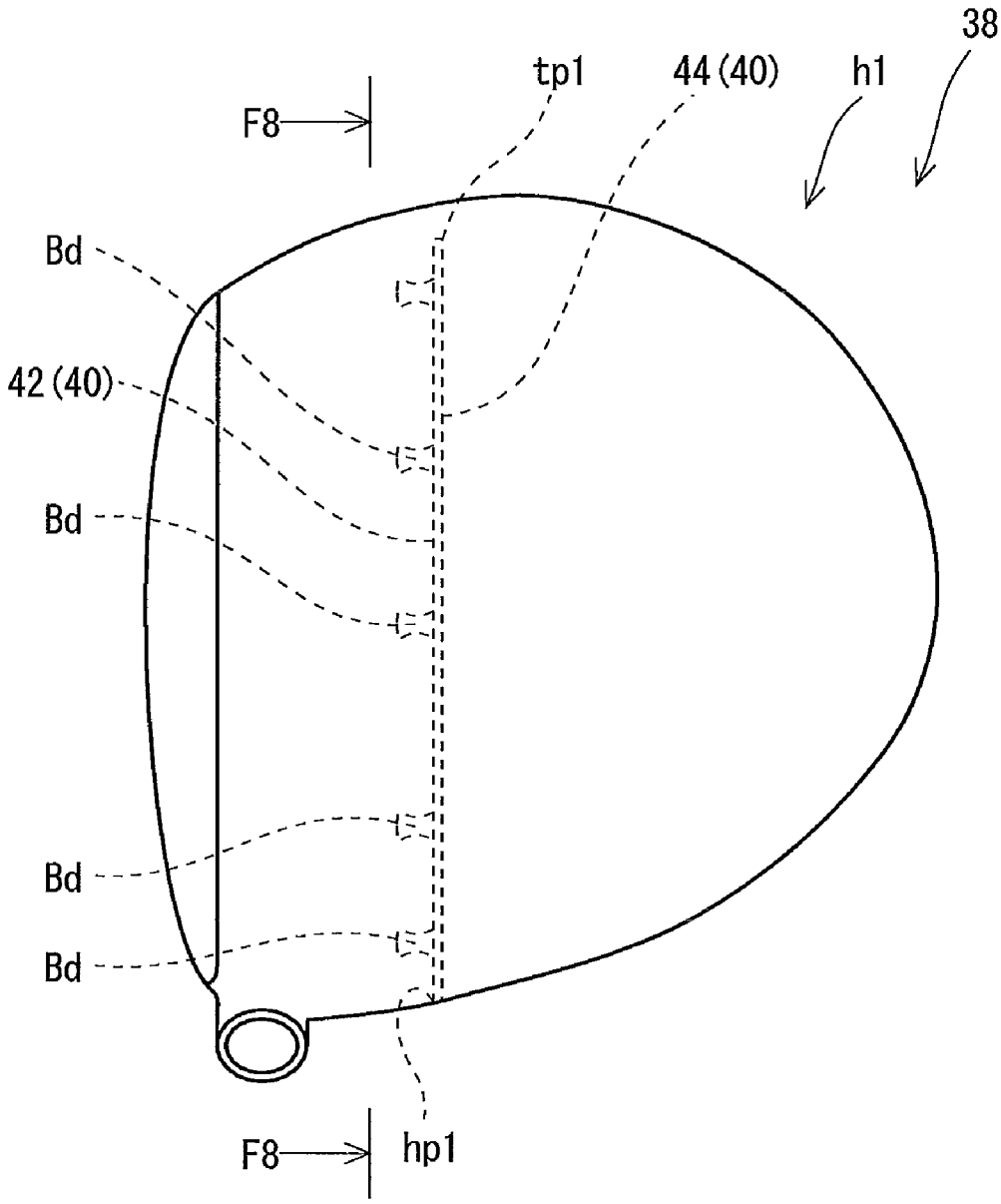
FIG. 7 is a plan view of a golf club head according to a third embodiment of the present invention, as viewed from a crown side.
Figure 8:
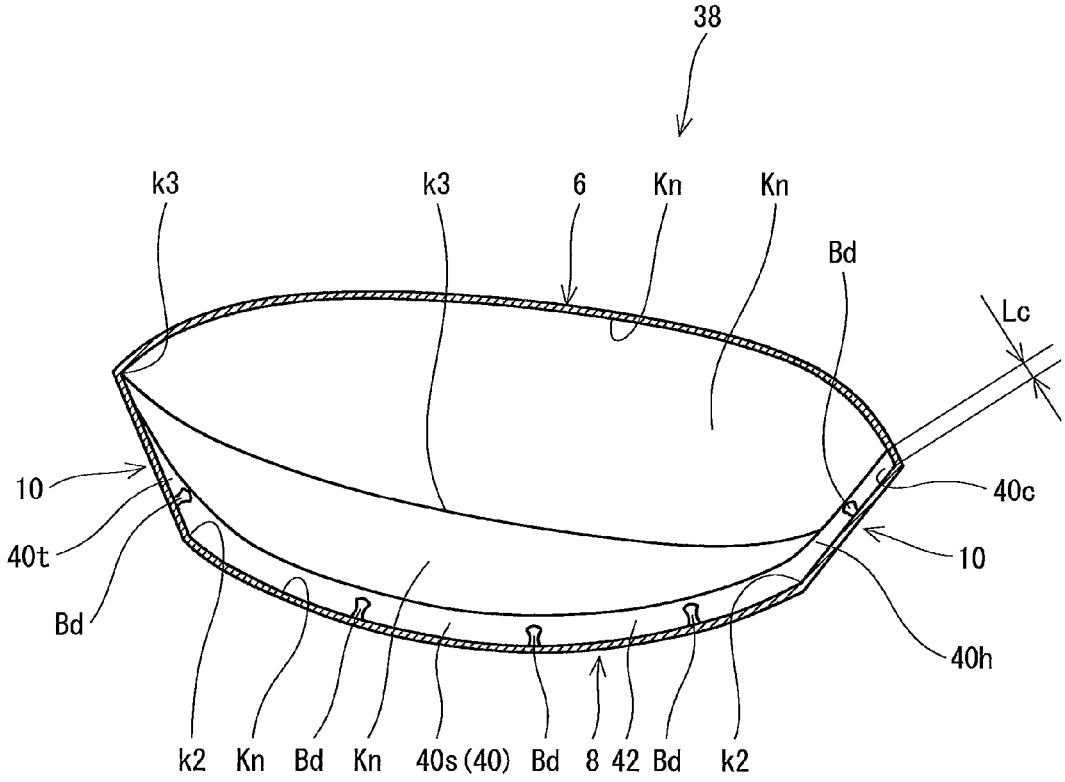
FIG. 8 is a sectional view taken along a line F8-F8 of FIG. 7.

FIGS. 7 and 8 show a head 38 according to a third embodiment of the present invention. FIG. 7 is a plan view of the head 38, as viewed from a crown side. FIG. 8 is a sectional view taken along a line F8-F8 of FIG. 7.

The head 38 is similar to the head 2. The difference between the head 38 and the head 2 is that a partial weld rib 40 extends to a crown. As shown in FIG. 8, the rib 40 continuously extends to a crown 6 via a sole 8 and a side 10 of a heel side from a side 10 of a toe side. More specifically, the rib 40 has a sole disposing part 40*s* located on the inner surface of the sole 8, a toe-side part 40*t* located on the side 10 of the toe side, a heel-side part 40*h* located on the side 10 of the heel side, and a crown disposing part 40*c* located on the inner surface of the crown 6. The crown disposing part 40*c* is provided on the heel side. The crown disposing part 40*c* is provided on the heel side of the heel-side part 40*h*.

Thus, an end of the heel side of the rib 40 extends to the crown 6. In the rib 40, the toe-side part 40*t*, the sole disposing part 40*s*, the heel-side part 40*h*, and the crown disposing part 40*c* are continuously provided. In the head 38, the crown disposing part 40*c* is provided on only the heel side. The crown disposing part 40*c* may be provided on the toe side. More specifically, an end of the toe side of the rib may extend to the crown 6. The crown disposing part 40*c* may be provided on the toe side and the heel side. More specifically, the ends of the toe side and the heel side of the rib may extend to the crown 6.

An end part (crown disposing part 40*c*) of the rib 40 may be welded to the crown 6 by a weld bead Bd, which is not shown in FIG. 8. The configuration of the weld bead Bd can be set to be the same as that of the other weld bead Bd shown in FIG. 8.

The crown 6 can be compressed and deformed in hitting a ball. The compression deformation of the crown 6 increases a loft angle. When the rib located on the crown 6 is excessively long, the compression deformation of the crown 6 may be excessively suppressed to reduce a launch angle. The reduction in the launch angle is apt to decrease a flight distance. When the rib located on the crown 6 is excessively long, a weight of the head is apt to be increased. When the rib located on the crown 6 is excessively long, a position of a center of gravity of the head is apt to be heightened. The launch angle is apt to be reduced by the high position of the center of gravity. In this case, the flight distance is apt to be reduced. In these respects, a length Lc (see FIG. 8) of the rib on the crown 6 is preferably equal to or less than 10 mm, more preferably equal to or less than 5 mm, and still more preferably equal to or less than 3 mm. The length Lc of the heel side of the rib 40 is shown in FIG. 8. The length Lc is a length of the crown disposing part 40*c*. When the crown disposing part 40*c* is provided on the toe side, the rib length Lc of the crown disposing part 40*c* of the toe side is also preferably equal to or less than 10 mm, more preferably equal to or less than 5 mm, and still more preferably equal to or less than 3 mm. In repent of eliminating a problem when the partial weld rib extends to the crown 6, the toe side and the heel side of the partial weld rib are preferably terminated at the side 10.

On the other hand, in respect of improvement in a hitting sound, it is preferable that the partial weld rib extends to the crown 6. More specifically, in respect of improvement in the hitting sound, it is preferable that the crown disposing part 40*c* is provided. The partial weld rib which is present on the crown 6 can further increase the frequency of the hitting sound. When the hitting sound is emphasized, it is preferable that at least one of the toe side and the heel side of the partial weld rib extends to the crown 6. In this case, it is more preferable that the toe side of the partial weld rib is terminated at the side 10, and the heel side of the partial weld rib is terminated at the crown 6. More specifically, it is preferable that the crown disposing part 40*c* is provided on only the heel side. Only the heel side extends to the crown 6, whereby the center of gravity of the head comes closer to the heel. The center of gravity of the head coming closer to the heel tends to close the head at impact, can suppress slice, and can stabilize a hitting directivity.

The partial weld rib 40 is a member (rib member) formed separately from a head body. The rib member is a long plate member. The partial weld rib 40 is fixed to a metal inner surface Kn by partially welding the rib member.

In the embodiment, a side surface 42 of the face side of the rib 40 is welded to the metal inner surface Kn. In the embodiment, a side surface 44 of the back side of the rib 40 is not welded to the metal inner surface Kn. In the embodiment, partial welding is carried out on only one side surface of both the side surfaces of the rib 40. The weld bead Bd is present on only the face side of the rib 40. The weld bead Bd is not present on the back side of the rib 40.

Figure 9:
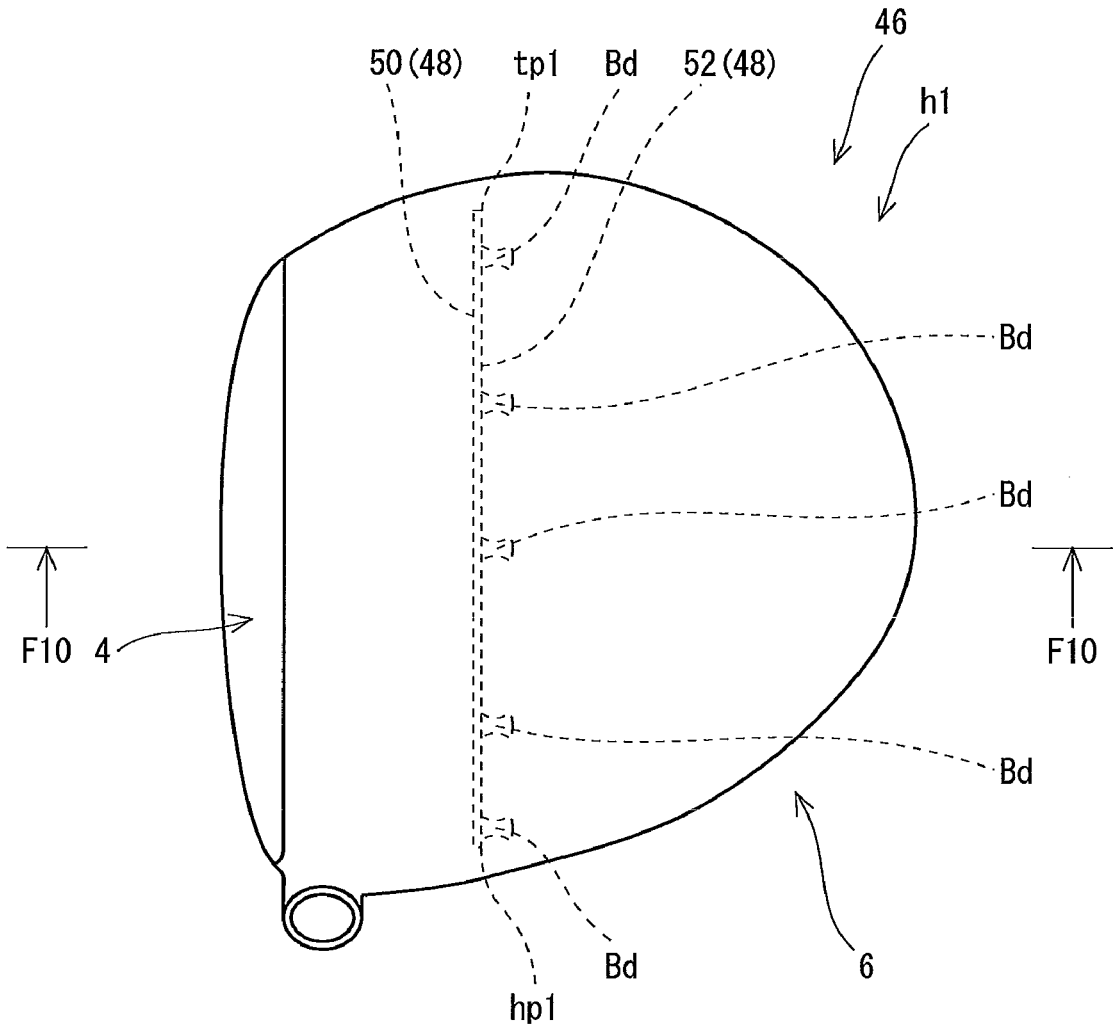
FIG. 9 is a plan view of a golf club head according to a fourth embodiment of the present invention, as viewed from a crown side.
Figure 10:
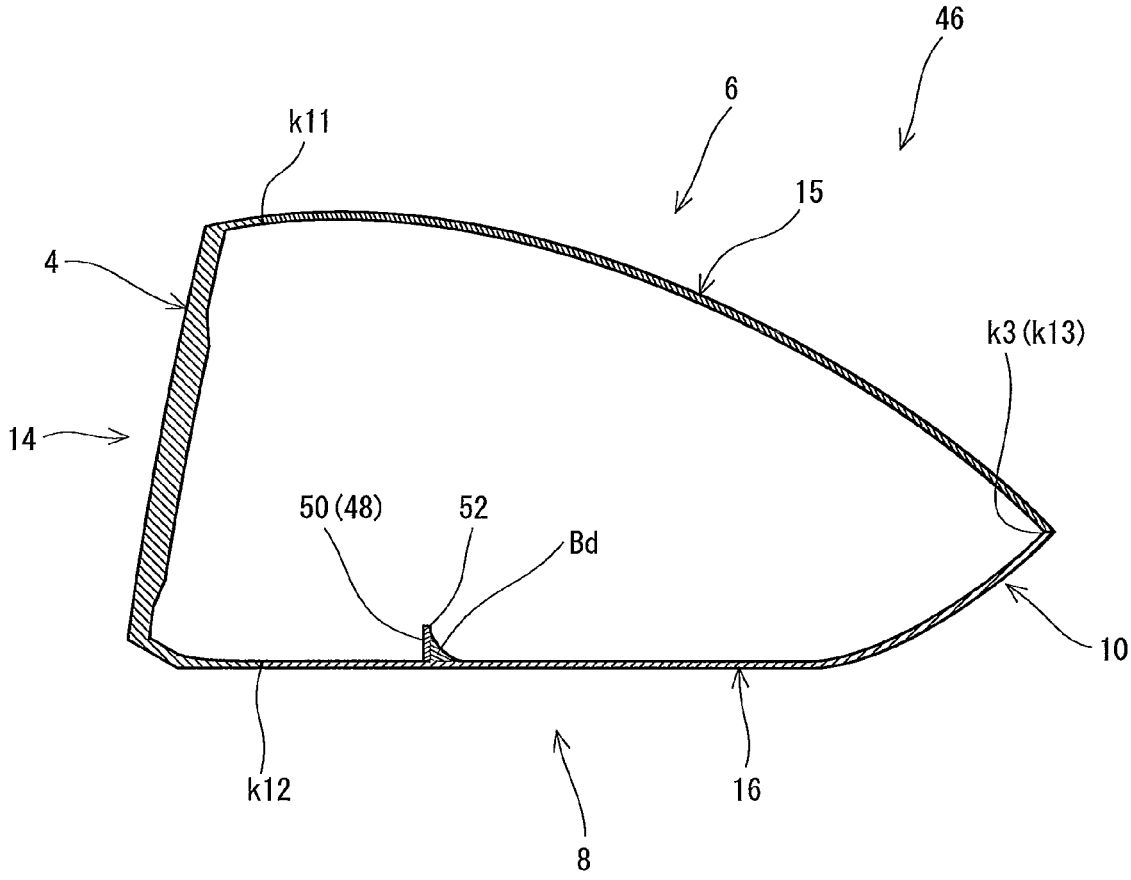
FIG. 10 is a sectional view taken along a line F10-F10 of FIG. 9.

FIGS. 9 and 10 show a head 46 according to a fourth embodiment. FIG. 9 is a plan view of the head 46, as viewed from a crown side. FIG. 10 is a sectional view taken along a line F10-F10 of FIG. 9.

In the head 46, the disposal of a partial weld rib and a head body are the same as those of the head 2. The difference between the head 46 and the head 2 is a position of a weld bead Bd.

In the embodiment, a side surface 50 of the face side of a partial weld rib 48 is not welded to a metal inner surface Kn. In the embodiment, the side surface 52 of the back side of the rib 48 is welded to the metal inner surface Kn. In the embodiment, partial welding is carried out on only one side surface of both the side surfaces of the rib 48. Welding of only one side surface is preferred for reason to be described later. The weld bead Bd is present on only the back side of the rib 48. The weld bead Bd is not present on the face side of the rib 48. As in the head 46, only a side surface of the back side of the rib can be welded in the present invention. However, from a viewpoint to be described later, only a side surface of the face side of the rib is more preferably welded.

Figure 11:
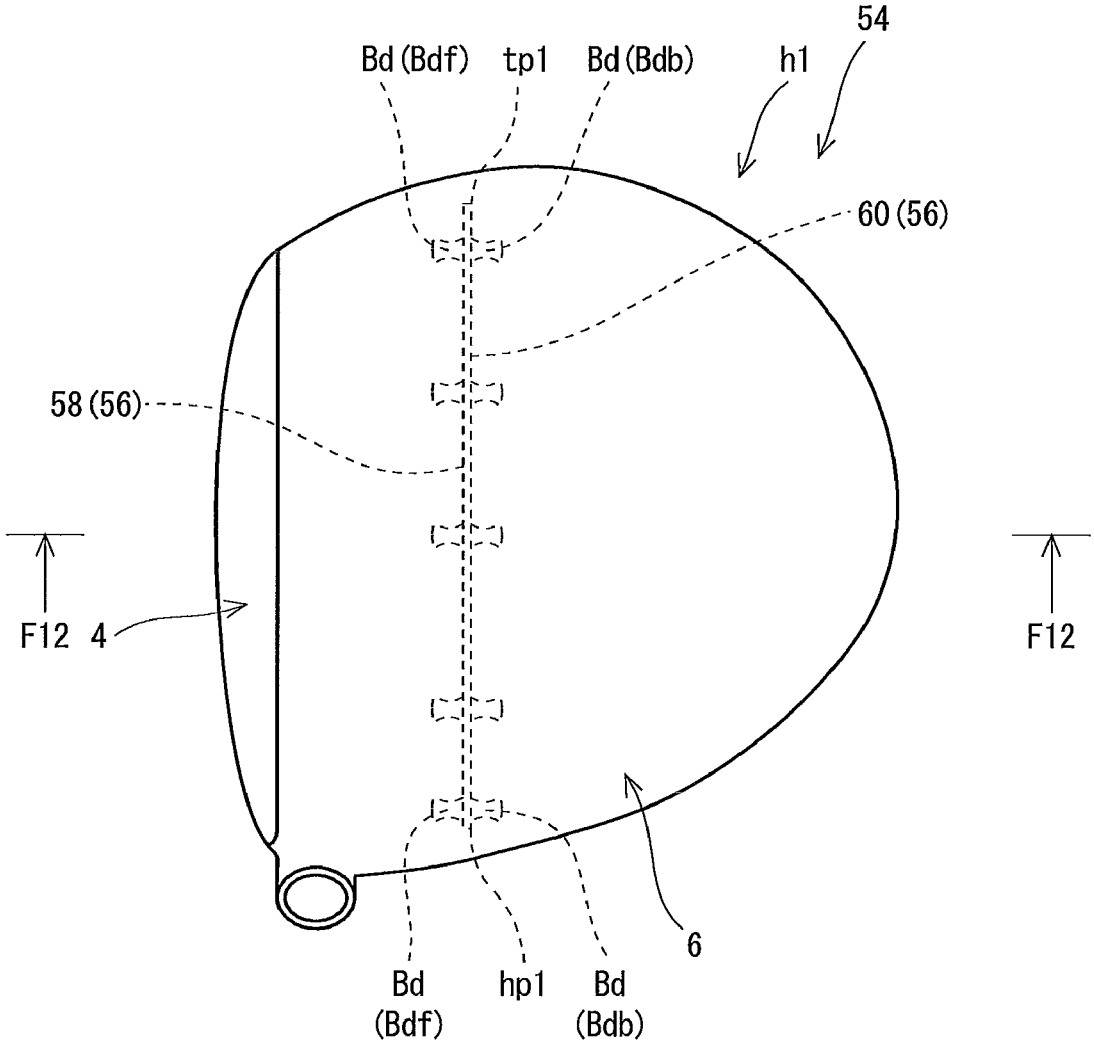
FIG. 11 is a plan view of a golf club head according to a fifth embodiment of the present invention, as viewed from a crown side.
Figure 12:
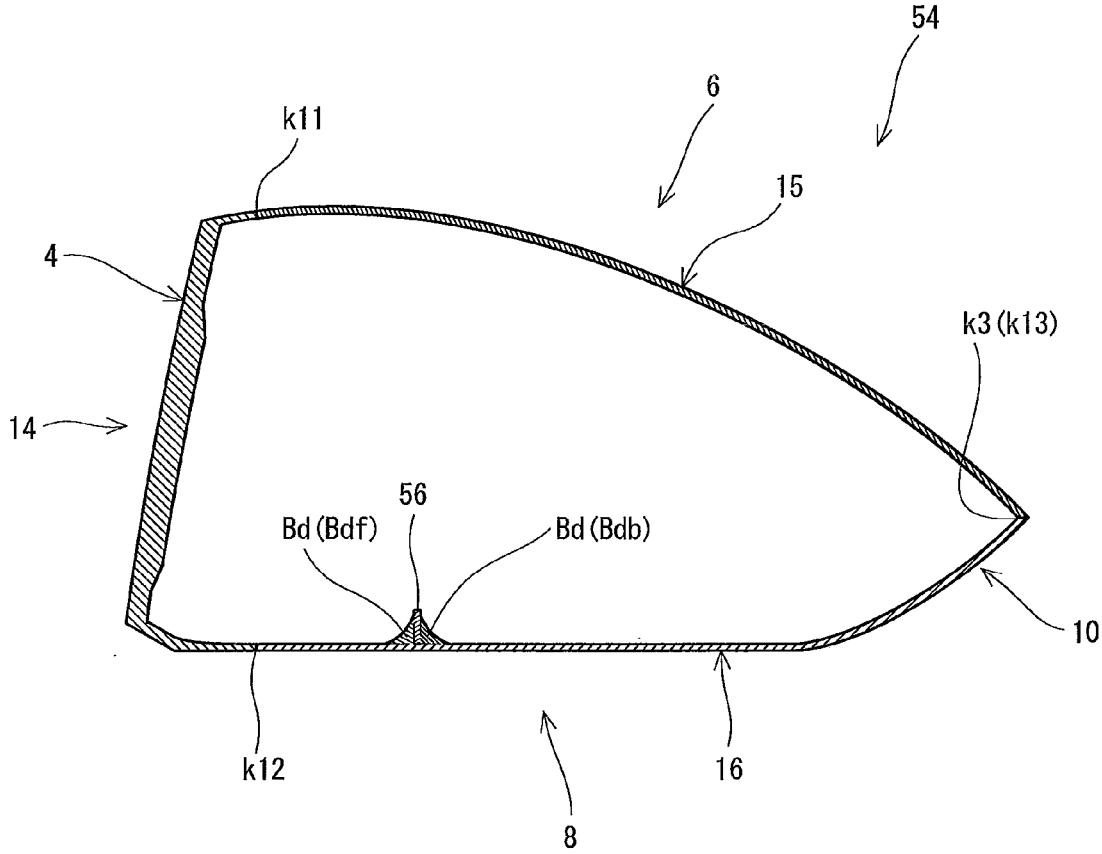
FIG. 12 is a sectional view taken along a line F12-F12 of FIG. 11.

FIGS. 11 and 12 show a head 54 according to a fifth embodiment. FIG. 11 is a plan view of the head 54, as viewed from a crown side, and FIG. 12 is a sectional view taken along a line F12-F12 of FIG. 11.

In the head 54, the rib longitudinal direction position and head body of a partial weld rib are the same as those of the head 2. The difference between the head 54 and the head 2 is the face-back direction positions of weld beads Bd, and the number of the weld beads Bd.

In the embodiment, a side surface 58 of the face side of a partial weld rib 56 is welded to a metal inner surface Kn. Furthermore, in the embodiment, a side surface 60 of the back side of the rib 56 is welded to the metal inner surface Kn. The weld bead Bd is present on the back side of the rib 56, and is present on the face side of the rib 56.

In at least two weld beads Bd, a position (a position in the longitudinal direction of the rib 56) of a weld bead Bdf of the face side may be the same as a position (a position in the longitudinal direction of the rib 56) of a weld bead Bdb of the back side. In the embodiment, in all the weld beads Bd, the position (the position in the longitudinal direction of the rib 56) of the weld bead Bdf of the face side is the same as the position (the position in the longitudinal direction of the rib 56) of the weld bead Bdb of the back side.

As in the head 54, both the side surfaces of the partial weld rib can be welded in the invention.

Figure 13:
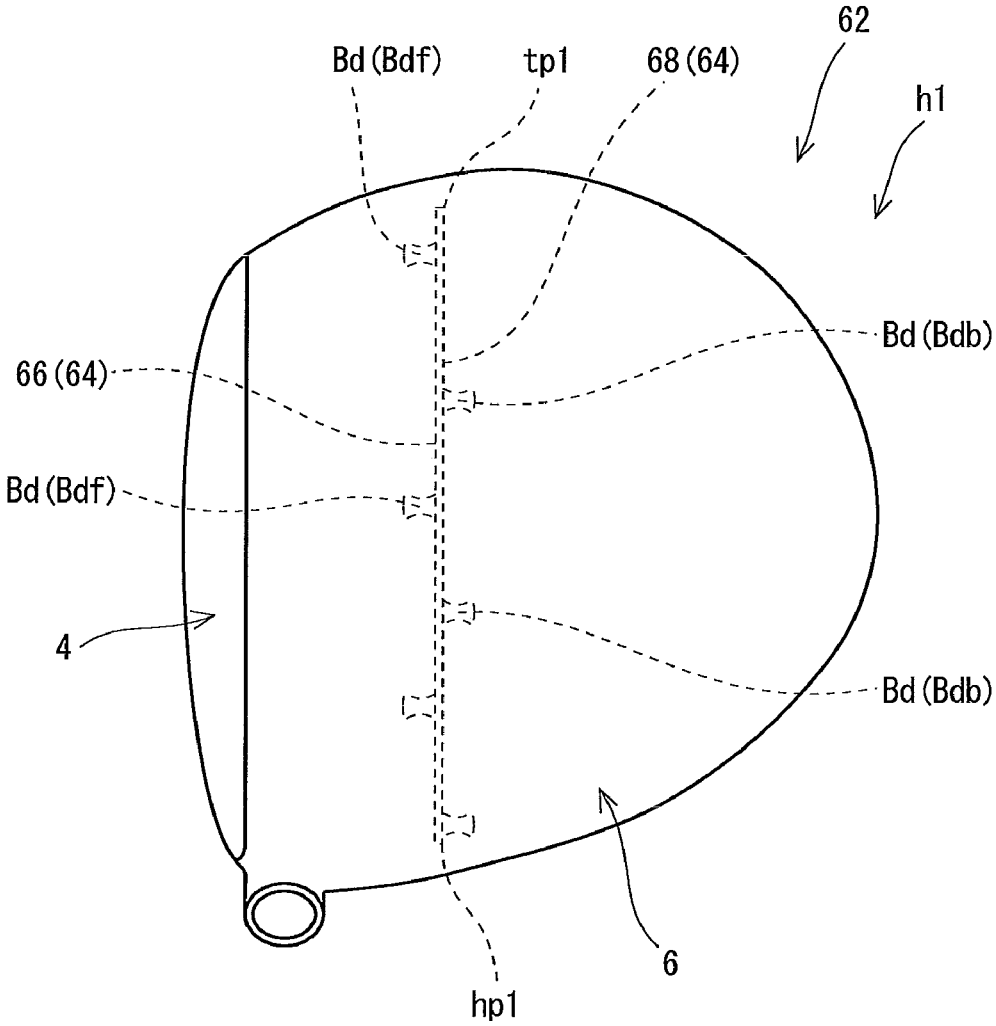
FIG. 13 is a plan view of a golf club head according to a sixth embodiment of the present invention, as viewed from a crown side.

FIG. 13 shows a head 62 according to a sixth embodiment. FIG. 13 is a plan view of the head 62, as viewed from a crown side.

In the head 62, the disposal of a partial weld rib and a head body are the same as those of the head 2. The difference between the head 62 and the head 2 is the positions and number of weld beads Bd. That is, the difference between the head 62 and the head 2 is the positions and number of welded places.

In the embodiment, a side surface 66 of the face side of a partial weld rib 64 is welded to a metal inner surface Kn. Furthermore, in the embodiment, a side surface 68 of the back side of the rib 64 is welded to the metal inner surface Kn. The weld bead Bd is present on the back side of the rib 64, and is present on the face side of the rib 64.

In at least two weld beads Bd, a position (a position in the longitudinal direction of the rib 64) of a weld bead Bdf of the face side may be different from a position (a position in the longitudinal direction of the rib 64) of a weld bead Bdb of the back side. In the embodiment, the position (the position in the longitudinal direction of the rib 64) of the weld bead Bdf of the face side is different from the position (the position in the longitudinal direction of the rib 64) of the weld bead Bdb of the back side in all the weld beads Bd. In the embodiment, the weld beads Bdb of the back side and the weld beads Bdf of the face side are alternately arranged.

As in the head 62, the present invention enables a configuration in which the rib longitudinal direction position of the weld bead Bdb of the back side is different from that of the weld bead Bdf of the face side.

Figure 14:
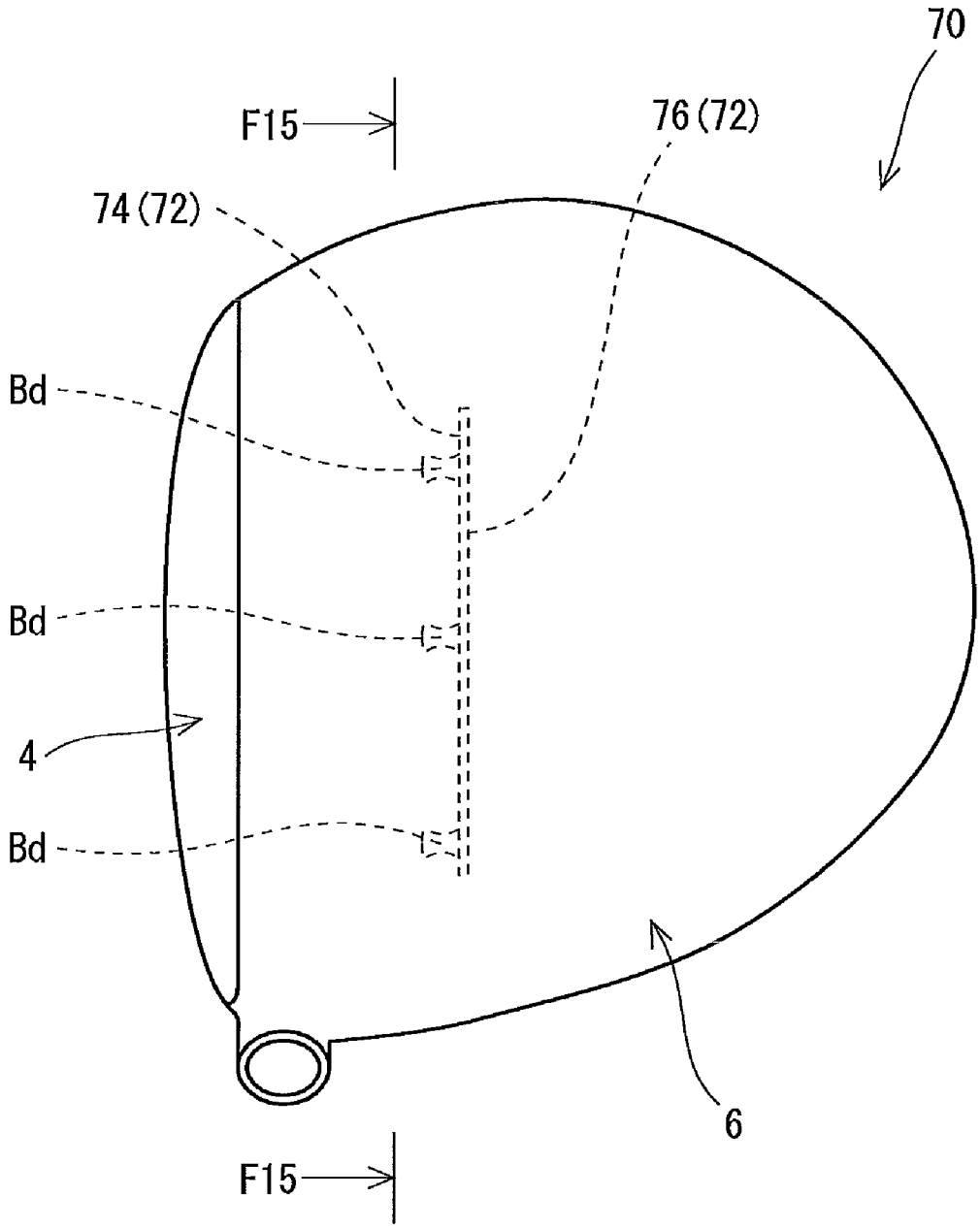
FIG. 14 is a plan view of a golf club head according to a seventh embodiment of the present invention, as viewed from a crown side.
Figure 15:
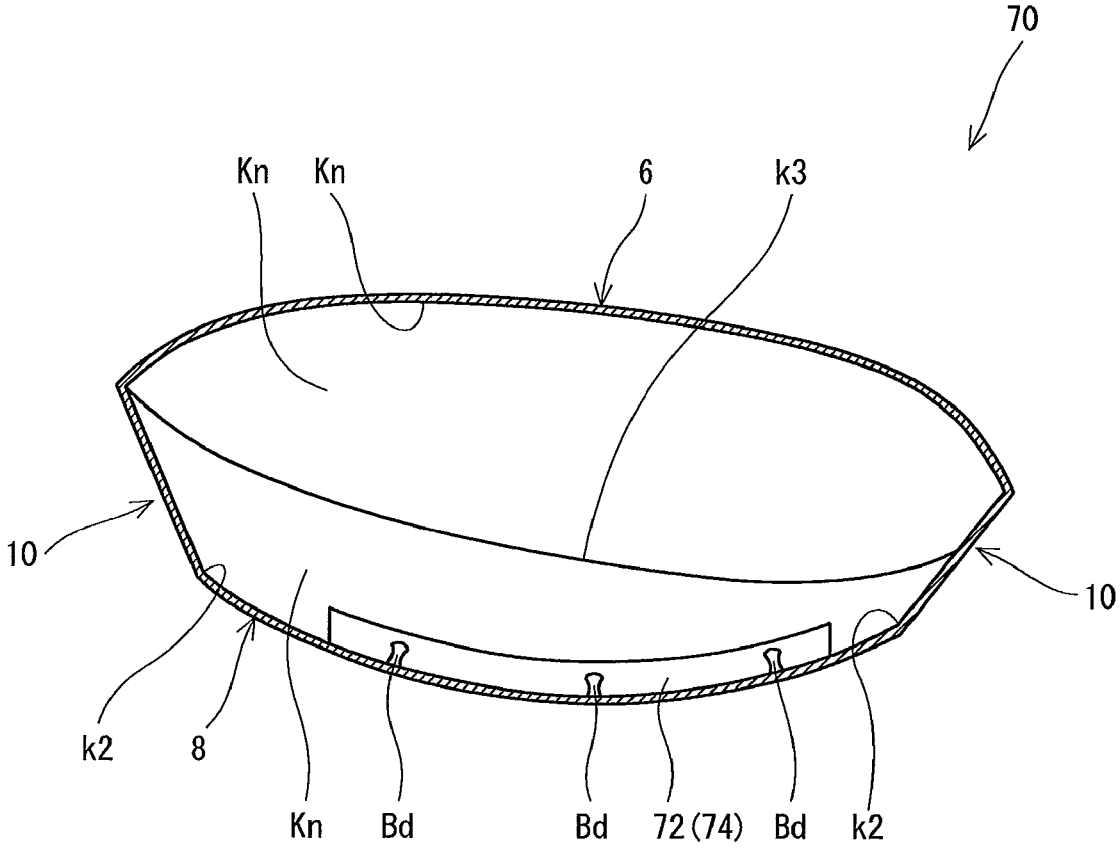
FIG. 15 is a sectional view taken along a line F15-F15 of FIG. 14.

FIGS. 14 and 15 show a head 70 according to a seventh embodiment. FIG. 14 is a plan view of the head 70, as viewed from a crown side. FIG. 15 is a sectional view taken along a line F15-F15 of FIG. 14.

The head 70 is the same as the head 2 except for the length of a partial weld rib and the number of weld beads Bd.

In the embodiment, a side surface 74 of the face side of a partial weld rib 72 is welded to the metal inner surface Kn. In the embodiment, a side surface 76 of the back side of the rib 72 is not welded to the metal inner surface Kn. The weld bead Bd is present on only the face side of the rib 72. The weld bead Bd is not present on the back side of the rib 72. In the embodiment, partial welding is carried out on only one side surface of both the side surfaces of the rib 72.

The rib 72 is present on only an inner surface of a sole 8. The rib 72 is not present on an inner surface of a crown 6. The rib 72 is not present on an inner surface of a side 10. The present invention enables such a constitution.

Figure 16:
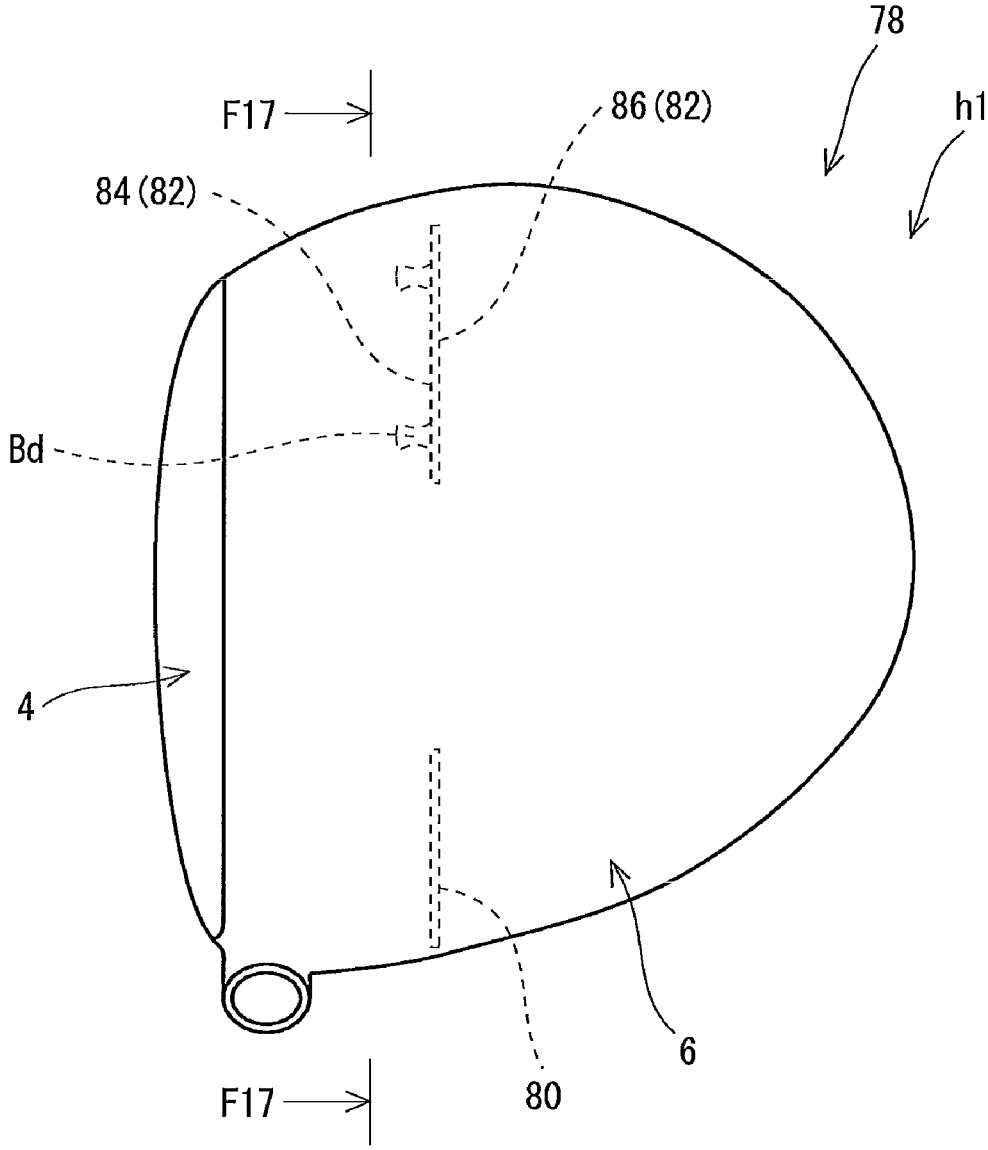
FIG. 16 is a plan view of a golf club head according to an eighth embodiment of the present invention, as viewed from a crown side.
Figure 17:
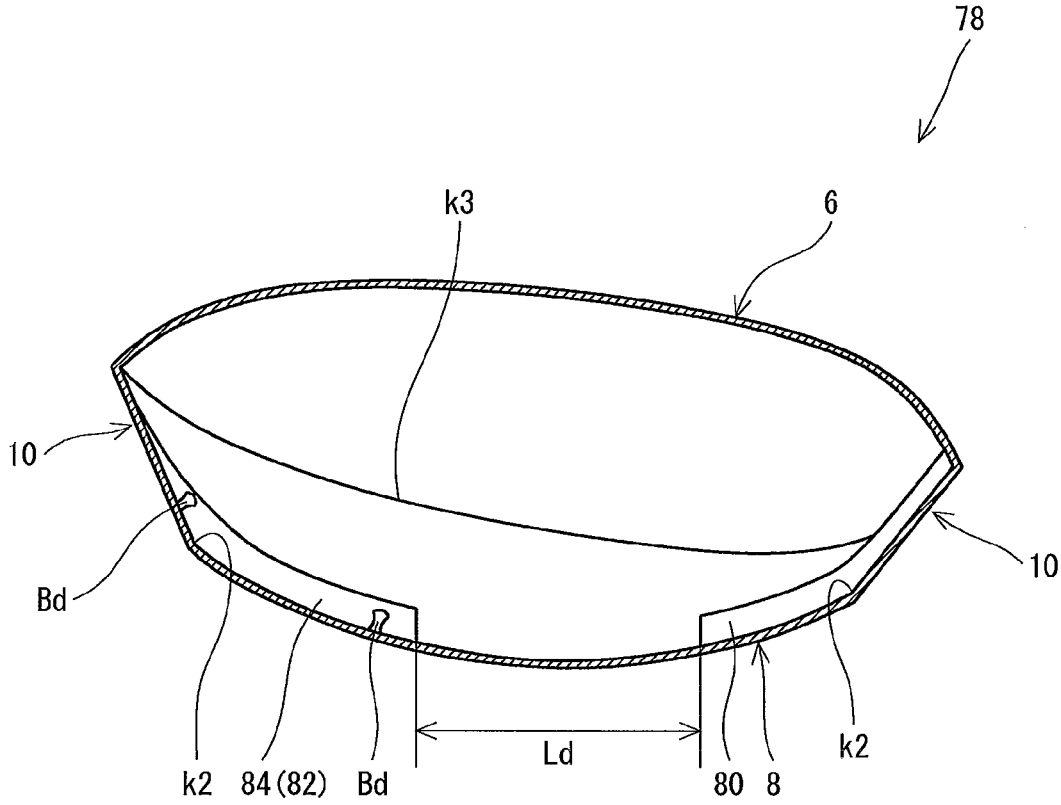
FIG. 17 is a sectional view taken along a line F17-F17 of FIG. 16.

FIGS. 16 and 17 show a head 78 according to an eighth embodiment. FIG. 16 is a plan view of the head 78, as viewed from a crown side. FIG. 17 is a sectional view taken along a line F17-F17 of FIG. 16.

The head 78 is the same as the head 2 except for the length of a partial weld rib, the presence of a nonpartial weld rib, the disposal of a weld bead Bd, and the number of weld beads Bd.

In the embodiment, a plurality of ribs are provided. A first rib 80 is not a partial weld rib. The rib 80 is a nonpartial weld rib. For example, the nonpartial weld rib 80 is integrally formed with at least a part of a head body. A second rib 82 is a partial weld rib. A side surface 84 of the face side of the rib 82 is welded to a metal inner surface Kn. Aside surface 86 of the back side of the rib 82 is not welded to the metal inner surface Kn. The weld bead Bd is present on only the face side of the rib 82. The weld bead Bd is not present on the back side of the rib 82. In the embodiment, partial welding is carried out on only one side surface of both the side surfaces of the rib 82.

The distance between the partial weld rib 82 and the rib 80 is shown by a double-pointed arrow Ld in FIG. 17. The length Ld is measured along a toe-heel direction. The length Ld is not restricted.

As in the head 78, the partial weld rib and a rib which is not the partial weld rib may coexist in the present invention.

Figure 18:
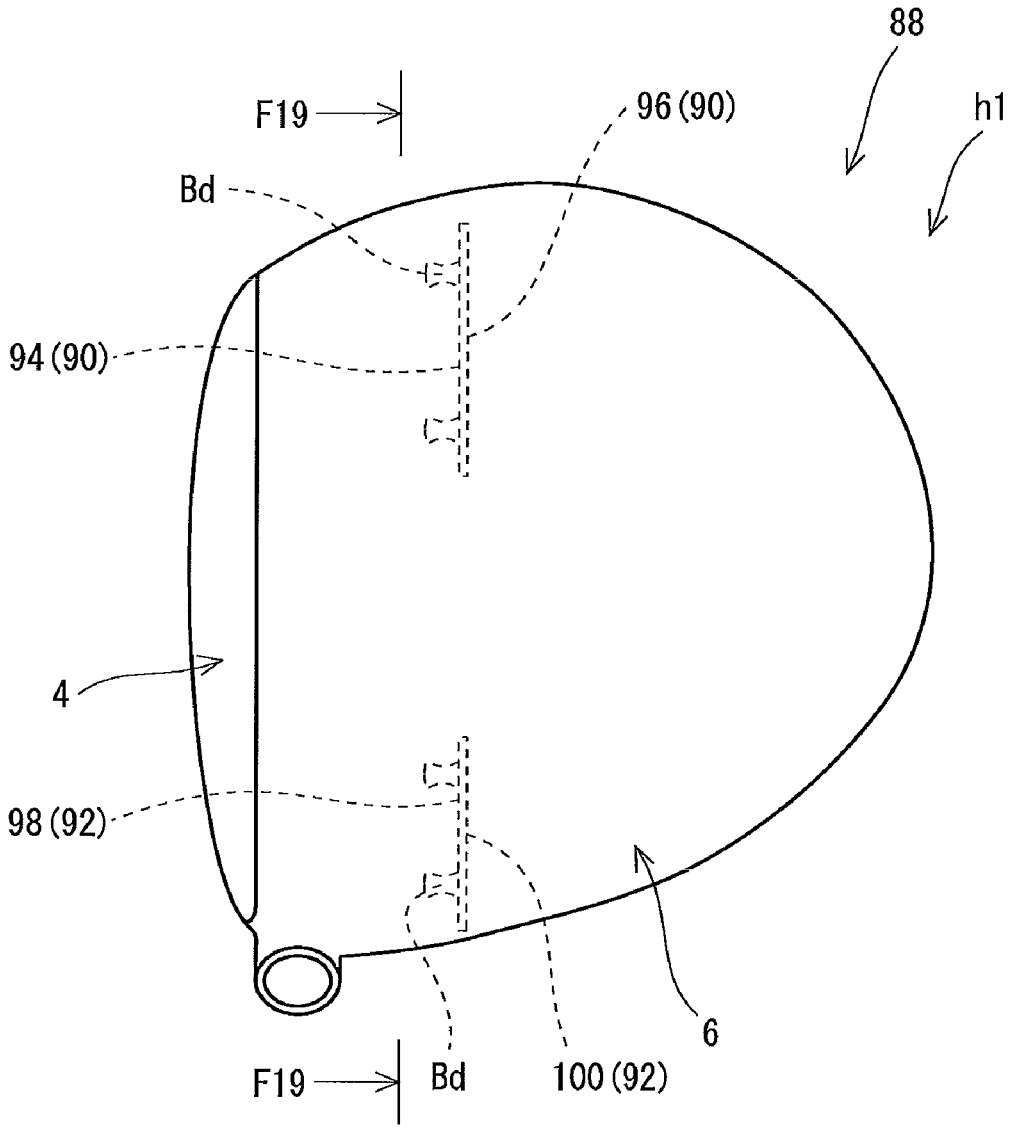
FIG. 18 is a plan view of a golf club head according to a ninth embodiment of the present invention, as viewed from a crown side.
Figure 19:
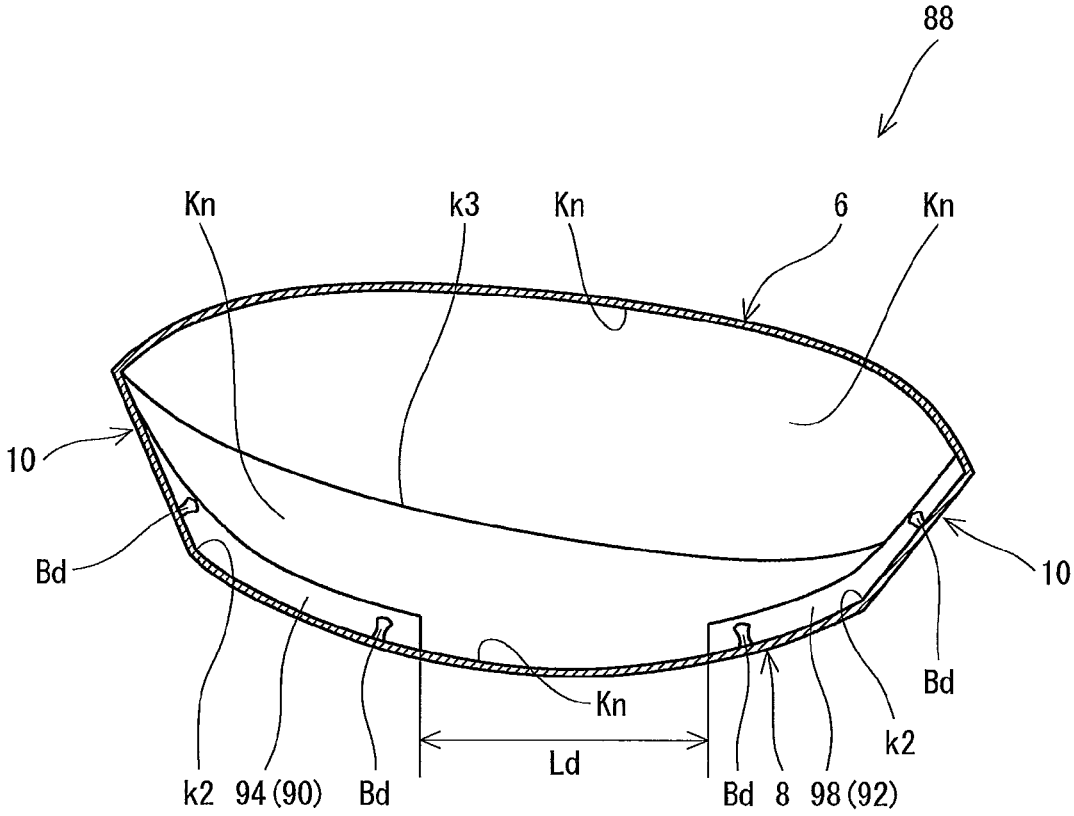
FIG. 19 is a sectional view taken along a line F19-F19 of FIG. 18.

FIGS. 18 and 19 show a head 88 according to a ninth embodiment. FIG. 18 is a plan view of the head 88, as viewed from a crown side. FIG. 19 is a sectional view taken along a line F19-F19 of FIG. 18.

The head 88 is the same as the head 2 except for the length of a partial weld rib, the number of partial weld ribs, the disposal of a weld bead Bd, and the number of weld beads Bd.

In the embodiment, a plurality of partial weld ribs are provided. More specifically, a first rib 90 is a partial weld rib, and a second rib 92 is a partial weld rib.

A side surface 94 of the face side of a rib 90 is welded to a metal inner surface Kn. A side surface 96 of the back side of the rib 90 is not welded to the metal inner surface Kn. A weld bead Bd is present on only the face side of the rib 90. The weld bead Bd is not present on the back side of the rib 90. In the embodiment, partial welding is carried out on only one side surface of both the side surfaces of the rib 90.

A side surface 98 of the face side of the rib 92 is welded to the metal inner surface Kn. A side surface 100 of the back side of the rib 92 is not welded to the metal inner surface Kn. The weld bead Bd is present on only the face side of the rib 92. The weld bead Bd is not present on the back side of the rib 92. In the embodiment, partial welding is carried out on only one side surface of both the side surfaces of the rib 92.

As in the head 88, the plurality of partial weld ribs may be present in the present invention.

As understood also from the embodiments, in the present invention, the welded portion and the unwelded portion coexist in the longitudinal direction of the partial weld rib between the metal inner surface Kn and the partial weld rib. More specifically, the head of the present invention has at least one partial weld rib.

As described above, the golf club head receives a strong impact shock force in hitting the ball. Whenever the head hits the ball, the head receives the strong impact shock force. The strong impact shock force is applied to the head repeatedly as the period of use of the golf club is increased. The crack of a bonded part of the rib and the omission of the rib are the serious problems for a person skilled in the art. From such a background, the person skilled in the art usually considers that welding is provided in the entire longitudinal direction of the rib. The welding provided in the entire longitudinal direction of the rib is also referred to as entire welding. An example of the entire welding is shown in comparative example to be described later.

The entire welding enhances the bonding strength of the rib. The entire welding can attain the adjustment of the hitting sound resulting from the rib. However, it was found that the entire welding may express the reduction in rebound performance and the reduction in hitting feeling. As an example of the reduction in hitting feeling, the increase in unpleasant impact in hitting the ball is exemplified.

A cause of the reduction in rebound performance by the entire welding is considered as follows. The entire welding excessively enhances the rigidity of a rib welding portion (the sole part or the like in the embodiment), and the excessive enhancement of the rigidity causes the reduction in rebound performance and hitting feeling. The entire welding increases weld time and widens a weld range. Therefore, the entire welding heats the head body near the rib in a large range over a long time. The heating may increase the hardness of the head body. The increase in the hardness may also cause the reduction in rebound performance. The increase in the hardness may cause the reduction in hitting feeling. The welding heat can further enhance the effect of the present invention when the hardness of the head body of the welding portion is increased.

The present invention employs the partial welding. The partial welding can suppress the excessive increase in the rigidity of the head body. The partial welding can suppress the reduction in rebound performance. The partial welding can suppress the reduction in hitting feeling. In particular, the partial welding can suppress the generation of unpleasant impact shock (vibration). It was found that the bonding strength of the rib can be sufficiently obtained even in the partial welding. Thus, the partial welding can suppress the reduction in rebound performance and the reduction in hitting feeling while surely bonding the rib to enhance the comprehensive performance of the head.

The partial weld rib and a rib other than the partial weld rib (nonpartial weld rib) may coexist. In this case, when the number of the partial weld ribs is defined as N1 and the number of the nonpartial weld ribs is defined as N2, [N1/(N1+N2)] is preferably equal to or greater than ½, and more preferably 1. More specifically, it is more preferable that all the ribs are the partial weld ribs.

The position of the partial weld rib is not restricted. The partial weld rib may be provided on only the sole, may be provided on only the side, or may be provided on only the crown. The partial weld ribs may be provided on two or more selected from the sole, the side, and the crown. One partial weld rib may be provided over two or more selected from the sole, the side, and the crown.

The partial welding may be carried out on the both the side surfaces of the partial weld rib, or may be carried out on only one side surface of both the side surfaces. When the weight of the weld bead Bd is great, a weight distributed to the head body is reduced, and the degree of freedom of design of the head is reduced. In respects of suppressing the weight of the weld bead Bd and of enhancing the workability of welding operation, it is preferable that the partial welding is carried out on only one side surface of both the side surfaces of the partial weld rib. In the respect, it is preferable that the weld bead Bd is provided on only one side surface of both the side surfaces of the partial weld rib.

The partial welding may be welding without the weld bead Bd. For example, the partial welding may be attained by only the fusion of base materials (the head body and the rib), without the weld bead Bd. However, in respect of obtaining the sufficient bonding strength also by the partial welding, welding with the weld bead Bd is preferred. The weld bead Bd may be produced by the fusion of the base material, or may be formed by the filler metal (weld rod or the like). The partial welding may be so-called spot welding. The "spot welding" is a welding method for welding by resistance heat of a current. The "spot welding" is a welding method for fusing only both the base materials without using the filler metal (weld rod or the like).

The partial welding of the present invention is may be welding which uses no filler metal. However, in respect of obtaining the sufficient bonding strength also by the partial welding, it is preferable that the weld bead Bd contains the filler metal.

In all the embodiments, the partial weld rib extends in the toe-heel direction. More specifically, in all the embodiments, the partial weld rib has a toe-heel direction length.

When the partial weld rib extends in the toe-heel direction, the partial weld rib is deformed so as to fall down to the face side at the moment of hitting. It is because the impact of the head and the ball causes the acceleration of the head which is opposite to the moving direction of the head at the moment of the impact. Therefore, when a tensile force applied to a root part of the face side of the partial weld rib is defined as Ff and a tensile force applied to a root part of the back side of the partial weld rib is defined as Fb, the force Fb is larger than the force Ff. The weld bead Bd is comparatively weak to tensile stress, and comparatively strong to compression stress. Consequently, in respects of enhancing the durability of the weld bead Bd and of suppressing a crack or the like, it is preferable that the weld beads Bd are provided on the face side of the partial weld rib. It is more preferable that a half or more of the weld beads Bd are provided on the face side of the partial weld rib. It is particularly preferable that all the weld beads Bd are provided on the face side of the partial weld rib. In respect of enjoying these effects, it is preferable that the extending direction of the partial weld rib is inclined or orthogonalized with respect to the face-back direction of the head. That is, it is preferable that the extending direction of the partial weld rib is not parallel to the face-back direction of the head. When at least a part of the partial weld rib is inclined or orthogonalized with respect to the face-back direction of the head, "the extending direction of the partial weld rib is inclined or orthogonalized with respect to the face-back direction of the head".

A height of the partial weld rib is shown by a double-pointed arrow HR in FIG. 2. A height of the weld bead Bd is shown by a double-pointed arrow HB in FIG. 3. A length (the length of the bottom part of the weld bead Bd) of the weld bead Bd is shown by a double-pointed arrow LB in FIG. 3. The height HR, the height HB, and the length LB are measured in each of the weld beads Bd.

A higher rib height HR involves the increase in the bonding strength of the rib. The weld bead Bd is preferably heightened in order to enhance the bonding strength of the rib. The length LB is preferably increased in order to enhance the bonding strength of the rib.

When the entire welding is temporarily carried out, the increase in the height HB or the increase in the length LB may cause the increase in the weight of the weld bead Bd, the reduction in productivity, the further reduction in rebound performance and in hitting feeling. Since the partial welding is used in the present invention, the increase in the weight and the reduction in productivity are suppressed even when the bead height HB and/or the length LB are increased. In these respects and in respect of a weld strength, it is preferable that the rib height HR satisfies the following item (a1); it is preferable that the bead height HB satisfies the following item (a2); and it is preferable that the length LB satisfies the following item (a3).

(a1) The rib height HR is preferably equal to or greater than 2 mm, more preferably equal to or greater than 3 mm, and still more preferably equal to or greater than 4 mm.

(a2) The bead height HB is preferably equal to or greater than 2 mm, more preferably equal to or greater than 3 mm, and still more preferably or greater 4 mm.

(a3) The bead length LB is preferably equal to or greater than 2 mm, more preferably equal to or greater than 3 mm, and still more preferably equal to or greater than 4 mm.

In the abovementioned respect, when a plurality of partial weldings are present, it is preferable that a half or more of the partial weldings satisfy the items (a1), (a2) and (a3). It is more preferable that all the partial weldings satisfy the items (a1), (a2) and (a3).

In respect of suppressing the increase in the rib weight, the rib height HR is preferably equal to or less than 8 mm, and more preferably equal to or less than 6 mm.

In respect of suppressing the increase in the weight of the weld bead Bd, the bead height HB is preferably equal to or less than 8 mm, and more preferably equal to or less than 6 mm.

In respect of suppressing the increase in the weight of the weld bead Bd, the bead length LB is preferably equal to or less than 8 mm, and more preferably equal to or less than 6 mm.

A distance between the adjacent partial weldings is shown by a double-pointed arrow c1 in FIG. 4. In the embodiment of FIG. 4, the distance c1 is a distance between the adjacent weld bead Bds. Hereinafter, the distance c1 is also referred to as a bead distance. A widthwise central surface PLc of the weld bead Bd is shown by a one-dotted chain line in an enlarged part of FIG. 1 and FIG. 4. As shown in FIGS. 1 and 4, a central point of a tip of the rib side of the weld bead Bd is defined as Bd1; a central point of a tip of the head body side of the weld bead Bd is defined as Bd2; and a central point of a root end of the weld bead Bd is defined as Bd3. The widthwise central surface PLc is a plane passing through the point Bd1, the point Bd2, and the point Bd3. The root end of the weld bead Bd is a point pk shared by the weld bead Bd, the metal inner surface Kn, and the side surface 24 of the rib. Two points pk are present in one weld bead Bd (see FIGS. 1 and 4). In the embodiment, the point Bd1 and the point Bd3 are drawn so as to be extremely close to each other in the enlarged part of FIG. 1. In FIG. 4, the point Bd2 and the point Bd3 are drawn so as to accidentally overlap with each other. Of course, the accidental proximity or the accidental overlapping on these drawings may not occur depending on the shape of the weld bead Bd.

The bead distance c1 is a distance between a point Bd2 of a weld bead Bd and a point Bd2 of a weld bead Bd adjacent thereto. The distance c1 is a distance between the partial weldings belonging to the same rib. As shown in FIG. 4, when the metal inner surface Kn is curved between the two points Bd2, the bead distance c1 is a length along the curved metal inner surface Kn. In the case of welding which has no weld bead Bd, the gravity point of the welding portion (welded portion) is determined, and a distance between the gravity points is defined as the distance c1.

In respect of suppressing the increase in the weight, the distance c1 is preferably equal to or greater than 10 mm, more preferably equal to or greater than 13 mm, and still more preferably equal to or greater than 16 mm. In respect of suppressing the vibration of the sole to obtain the hitting sound of high frequency, the distance c1 is preferably equal to or less than 25 mm, more preferably equal to or less than 23 mm, and still more preferably equal to or less than 21 mm.

The number of the weld beads Bd per one rib is preferably equal to or greater than two, and more preferably equal to or greater than three. The plurality of weld beads Bd can enhance the weld strength.

FIG. 3 is a sectional view of the widthwise central surface PLc. In the section, a traverse width of an end part of the weld bead Bd is defined as T1 (mm), and the minimum traverse width is defined as T2 (mm). In the section, a straight line L1, a straight line L2, and a straight line L3 are defined. The straight line L1 is a straight line passing through the point Bd1 and the point Bd2. The straight line L3 is a straight line which is parallel to the straight line L1 and passes through the point Bd3. The straight line L2 is a straight line closest to the point Bd3 under the condition that the straight line L2 passes through at least one point of the surface Bds and is parallel to the straight line L1.

A width T1 is a distance (shortest distance) between the straight line L1 and the point Bd3. That is, the width T1 is a distance between the straight line L1 and the straight line L3. A width T2 is a distance between the straight line L2 and the straight line L3.

As shown in FIG. 3, in the section of the widthwise central surface PLc, the surface Bds of the bead Bd has a concave shape. That is, the surface Bds has a convex shape toward the point Bd3. The shape of the weld bead Bd increases a contact area of the bead Bd and the rib 20 and a contact area between the bead Bd and the metal inner surface Kn, and suppresses the volume of the bead Bd. The constitution can suppress the weight of the weld bead Bd and increase the weld strength. In this respect, a ratio (T2/T1) is preferably equal to or less than 0.95, more preferably equal to or less than 0.9, and still more preferably equal to or less than 0.8. When the ratio (T2/T1) is excessively small, stress is apt to concentrate on the central part of the weld bead Bd. The stress concentration may reduce the durability of the rib. In respect of the durability of the rib, the ratio (T2/T1) is preferably equal to or greater than 0.5, more preferably equal to or greater than 0.6, and still more preferably equal to or greater than 0.7.

When three or more partial weldings are carried out in the single partial weld rib, the maximum value of the distance c1 between the adjacent partial weldings (for example, the weld beads Bd) is defined as Cmax (mm), and the minimum value is defined as Cmin (mm).

When Cmax (mm) is equal to the minimum value Cmin (mm), more specifically, when the partial weldings (weld beads Bd) set at equal intervals are present, rib vibration in which the welding portion is a node and an antinode is apt to be generated. The vibration is apt to apply a strong force to, particularly, the welding portion near the antinode of the vibration. The force is apt to generate the crack and coming off of the welding portion.

Therefore, it is preferable that Cmax (mm) is not equal to the minimum value Cmin (mm). Specifically, a difference (Cmax−Cmin) is preferably equal to or greater than 1 mm, more preferably equal to or greater than 2 mm, and still more preferably equal to or greater than 3 mm.

The upper limit value of the difference (Cmax−Cmin) may be set according to the length of the partial weld rib. When the difference (Cmax−Cmin) is excessively great, in respect of enhancing the durability of the welding portion in a portion in which the distance c1 is the maximum, the difference (Cmax−Cmin) may be equal to or less than 10 mm, and further equal to or less than 5 mm.

The maximum width of the weld bead Bd is shown by a double-pointed arrow W1 in FIG. 1. In respect of the weld strength, the maximum width W1 is preferably equal to or greater than 2 mm, more preferably equal to or greater than 3 mm, and still more preferably equal to or greater than 4 mm. In respect of suppressing the weight of the weld bead Bd, the maximum width W1 is preferably equal to or less than 8 mm, more preferably equal to or less than 7 mm, and still more preferably equal to or less than 5 mm.

A distance between a rib end hp1 and the weld bead Bd closest to the rib end hp1 is shown by a double-pointed arrow S1 in FIG. 4. When the weld bead Bd is present, the starting point of the distance S1 is a point closest to the rib end among the points belonging to the weld bead Bd. Only the distance S1 of the heel side is shown in FIG. 4. However, a distance between a rib end tp1 of the toe side and the weld bead Bd closest to the rib end tp1 is also the distance S1.

In respect of the durability of the welding portion closest to the rib end, the distance S1 is preferably equal to or less than 15 mm, more preferably equal to or less than 10 mm, and still more preferably equal to or less than 8 mm. The distance S1 may be 0 mm. In both one end and other end of the rib, the distance S1 is more preferably equal to or less than 15 mm, more preferably equal to or less than 10 mm, and still more preferably equal to or less than 8 mm. The distance S1 may be 0 mm.

In respect of the productivity of the welding operation, the distance S1 is preferably equal to or greater than 1 mm, and more preferably equal to or greater than 2 mm. In both one end and other end of the rib, the distance S1 is more preferably equal to or greater than 1 mm, and still more preferably equal to or greater than 2 mm.

Regarding the partial welding, the type of the welding is not restricted. The types of the welding include gas welding, arc welding, electroslag welding, thermit welding, and laser welding. In respects of the workability and the bonding strength, the arc welding is preferred, and TIG welding which is a type of arc welding is particularly preferred.

Figure 5:
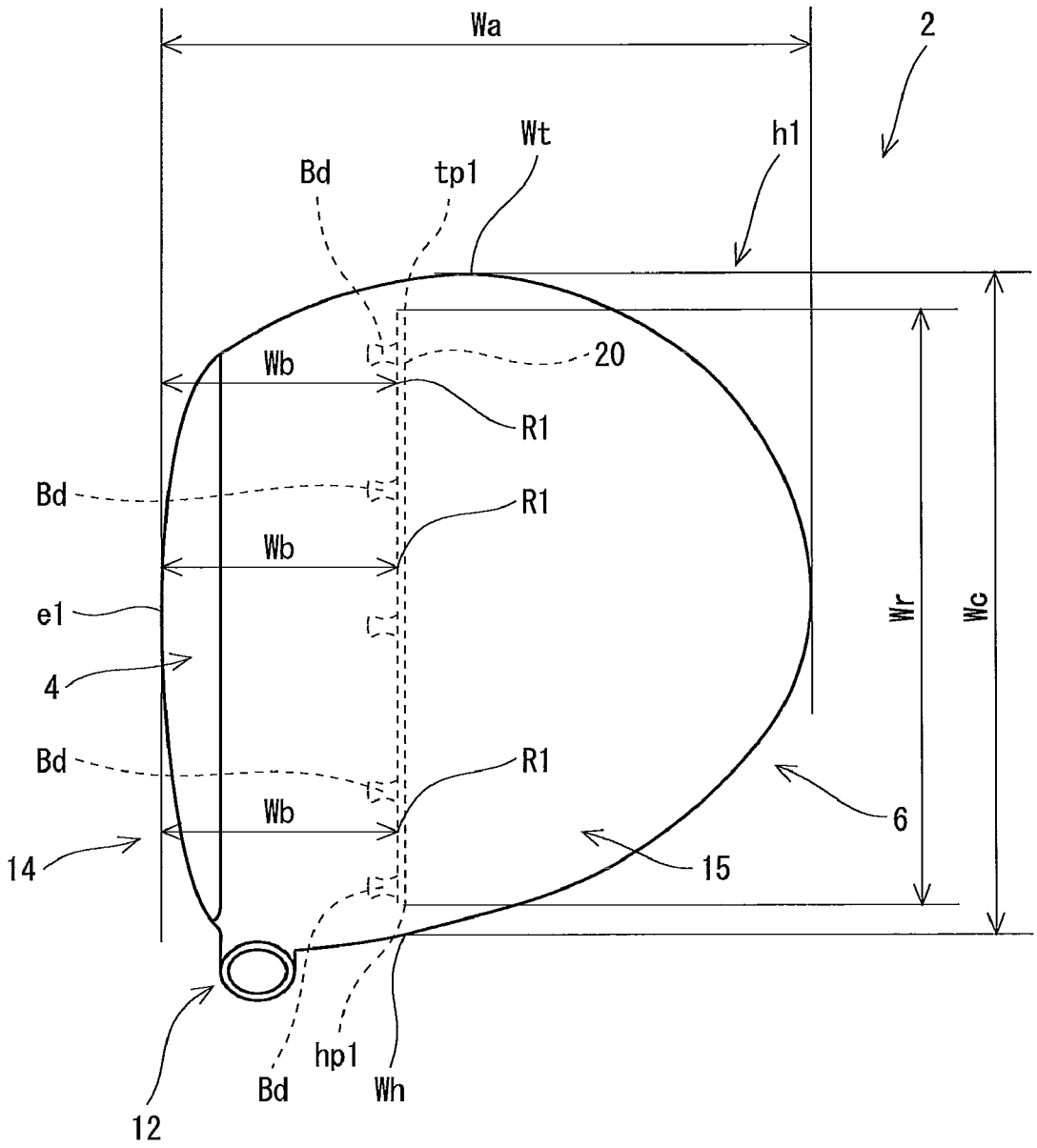
FIG. 5 is a plan view of a golf club head according to a first embodiment, as viewed from a crown side as in FIG. 1.

A forefront point of the head is shown by numeral character e1 in FIG. 5. The forefront point e1 is a point located on the most face side (front) in the head of the standard condition. The forefront point e1 is usually included in a leading edge.

A width of the head is shown by numeral character Wa in FIG. 5. The width of the head is the maximum width of the head in the face-back direction. The width Wa of the head is measured based on a projected image obtained by projecting the head of the standard condition on the horizontal plane H. The projection direction of the projection is a direction perpendicular to the horizontal plane H.

Points belonging to the rib 20 are shown by numeral character R1 in FIG. 5. A great number of points R1 are present.

A face-back direction distance between the forefront point e1 and the point R1 is shown by numeral character Wb in FIG. 5. The distance Wb is determined by each of the points R1 belonging to the rib 20.

A length of the head is shown by numeral character Wc in FIG. 5. The length of the head is a toe-heel direction length between a point Wh of the heel side and a point Wt of the toe side. The point Wt is a point located on the most toe side in the head of the standard condition. When the point Wh is determined, a horizontal plane H1 vertically separated from the horizontal plane H by 22.23 mm in the head of the standard condition is considered. A point located on the most heel side among the points which are included in the horizontal plane H1 and are included also in the head is the point Wh. The length of the head Wc is a distance in the toe-heel direction between the point Wt and the point Wh.

A length of the rib 20 is shown by numeral character Wr in FIG. 5. The rib length Wr is measured based on the projected image Tr obtained by projecting the rib 20 on the horizontal plane H in the head 2 of the standard condition. The projection direction of the projection is perpendicular to the horizontal plane H. The length Wr of the rib is a length in the toe-heel direction.

When a ratio (Wb/Wa) is excessively small, the partial weld rib is apt to be separated from the antinode of vibration, and an effect of suppressing vibration is apt to be reduced. In respect of suppressing the vibration of the sole 8 and the side 10 to increase the frequency of the hitting sound, the ratio (Wb/Wa) for all the points R1 is preferably equal to or greater than 0.18, and more preferably equal to or greater than 0.21.

When the ratio (Wb/Wa) is excessively great, the partial weld rib is apt to be separated from the antinode of vibration, and an effect of suppressing vibration is apt to be reduced. In respect of suppressing the vibration of the sole 8 and the side 10 to increase the frequency of the hitting sound, the ratio (Wb/Wa) for all the points R1 is preferably equal to or less than 0.50, more preferably equal to or less than 0.46, still more preferably equal to or less than 0.40, and particularly preferably equal to or less than 0.38.

The partial weld rib may extend in a curved condition. Even when the partial weld rib extends in the curved condition, it is preferable that the ratio (Wb/Wa) for all the points R1 satisfies the preferred range described above. In respects of suppressing the weight of the partial weld rib and of enhancing a vibration suppressing effect, it is more preferable that the partial weld rib extends straightly.

As shown in FIG. 3, a roundness of a curvature radius rx may be applied to a root Rx of the partial weld rib. The roundness can relax the stress concentration to the root part of the rib, particularly, in a portion in which the weld bead Bd is not present. In respect of enhancing the durability of the partial weld rib, the curvature radius rx is preferably equal to or greater than 0.5 mm, and more preferably equal to or greater than 1.0 mm. In respect of suppressing the weight of the partial weld rib, the curvature radius rx is preferably equal to or less than 3.0 mm, and more preferably equal to or less than 2.0 mm.

As shown in the enlarged view of FIG. 2, a roundness of a curvature radius ry is preferably applied to an edge Ry of the upper surface of the partial weld rib. In respect of enhancing the durability of the partial weld rib, the curvature radius ry is preferably equal to or greater than 0.2 mm, and more preferably equal to or greater than 0.4 mm. The upper limit of the curvature radius ry is restrained by the width of the rib. The entire upper surface of the rib may be a curved surface having a constant curvature radius rc in the sectional view of FIG. 2. A preferred value of the curvature radius rc is equal to a preferred value of the curvature radius ry.

The width Wa of the head is not restricted. In respects of deepening a depth of center of gravity and of increasing a moment of inertia, the width Wa of the head is preferably equal to or greater than 100 mm, more preferably equal to or greater than 107 mm, and still more preferably equal to or greater than 115 mm. In respect of observing the rules for the golf club, the width Wa of the head is preferably equal to or less than 127 mm, and particularly preferably 125 mm when the error of measurement of 2 mm is considered.

The length Wc of the head is not restricted. In respects of widening the face and of increasing the moment of inertia, the length Wc of the head is preferably equal to or greater than 100 mm, more preferably equal to or greater than 107 mm, and still more preferably equal to or greater than 115 mm. In respect of observing the rules for the golf club, the length Wc of the head is preferably equal to or less than 127 mm, and particularly preferably 125 mm when the error of measurement of 2 mm is considered.

The volume of the head is not restricted. In respects of the increase of the moment of inertia and of the enlargement of a sweet area, the volume of the head is preferably equal to or greater than 400 cc, more preferably equal to or greater than 420 cc, and still more preferably equal to or greater than 440 cc. In respect of observing the rules for the golf club, the volume of the head is preferably equal to or less than 470 cc, and particularly preferably 460 cc when the error of measurement of 10 cc is considered.

The weight Mh of the head is not restricted. In respect of swing balance, the weight Mh of the head is preferably equal to or greater than 175 g, more preferably equal to or greater than 180 g, and still more preferably equal to or greater than 185 g. In respect of the swing balance, the weight Mh of the head is preferably equal to or less than 205 g, more preferably equal to or less than 200 g, and still more preferably equal to or less than 195 g.

The weight Mr of the rib is not restricted. In respect of suppressing the vibrations of the sole and side to obtain a high hitting sound, the weight Mr of the rib is preferably equal to or greater than 1.0 g, more preferably equal to or greater than 1.2 g, and still more preferably equal to or greater than 1.5 g. When the weight of the rib is excessive, the weight capable of being distributed to the head body decreases, and the moment of inertia is reduced. In this respect, the weight Mr of the rib is preferably equal to or less than 5.0 g, more preferably equal to or less than 4.0 g, and still more preferably equal to or less than 3.0 g.

A ratio (Mr/Mh) of the weight Mr of the rib to the weight Mh of the head is not restricted. In respect of obtaining the high hitting sound, the ratio (Mr/Mh) is preferably equal to or greater than 0.008, more preferably equal to or greater than 0.009, and still more preferably equal to or greater than 0.010. When the weight of the rib is excessive, the weight capable of being distributed to the head body decreases, and the moment of inertia is reduced. In this respect, the ratio (Mr/Mh) is preferably equal to or less than 0.025, more preferably equal to or less than 0.020, and still more preferably equal to or less than 0.015.

The width of the rib is shown by a double-pointed arrow BR in the enlarged view of FIG. 2. In respect of enhancing the hitting sound, the average value of the width BR of the rib is preferably equal to or greater than 0.5 mm, more preferably equal to or greater than 0.7 mm, and still more preferably equal to or greater than 0.9 mm. In respect of suppressing the weight of the rib, the average value of the width BR of the rib is preferably equal to or less than 1.5 mm, more preferably equal to or less than 1.3 mm, and still more preferably equal to or less than 1.1 mm. The length of a part of the rib having the width BR of 0.5 mm or greater and 1.5 mm or less is preferably equal to or greater than 50% of the entire length of the rib, more preferably equal to or greater than 80%, and particularly preferably 100%.

The ratio (Wr/Wc) of the length Wr of the rib to the length Wc of the head is not restricted. In respect of enhancing the effect caused by the rib, the ratio (Wr/Wc) is preferably equal to or greater than 0.80, more preferably equal to or greater than 0.85, and still more preferably equal to or greater than 0.90. It is difficult to set the ratio (Wr/Wc) to 1. In this respect, the ratio (Wr/Wc) is preferably equal to or less than 0.98, and more preferably equal to or less than 0.95.

"A primary natural frequency" obtained by exciting the sole is not restricted. The hitting sound is related to the vibrations of the sole or side. The primary natural frequency correlates with the hitting sound.

When the primary natural frequency is high, the hitting sound in actual hitting also tends to be raised. In this respect, the primary natural frequency is preferably equal to or greater than 3000 Hz, more preferably equal to or greater than 3400 Hz, and still more preferably equal to or greater than 3500 HZ. When the primary natural frequency is excessively high, rebound performance may be reduced, and there is limit on the design of the head. In these respects, the primary natural frequency can be also set to be equal to or less than 5000 Hz, and further be equal to or less than 4000 Hz. The measuring method of the primary natural frequency will be described later.

The number of the partial weld ribs is not restricted. In respect of suppressing the weight of the partial weld rib, the number of the partial weld ribs leading to the side of the heel side from the side of the toe side via the sole is preferably equal to or less than 2, and particularly preferably 1. In addition to the partial weld rib leading to the side of the heel side from the side of the toe side via the sole, the other partial weld rib may be provided. The partial weld rib leading to the side of the heel side from the side of the toe side via the sole may be connected to the other partial weld rib or the other nonpartial weld rib. In respect of suppressing the weight of the partial weld rib, it is also preferable that a rib other than the partial weld rib leading to the side of the heel side from the side of the toe side via the sole is not provided on the sole and the side.

An angle (degree) between the extending direction of the projection image Tr of the partial weld rib and the toe-heel direction is shown by a double-pointed arrow θ1 in FIG. 6. When the projection image Tr of the rib is curved, the angle θ1 is an angle between each of tangents of the projection image Tr and the toe-heel direction. In respect of suppressing the vibration of the sole to enhance the hitting sound, the absolute value of the angle θ1 is preferably equal to or less than 10 degrees, more preferably equal to or less than 7 degrees, and still more preferably equal to or less than 4 degrees.

The material for the head is not restricted. As the material of the head, a metal, CFRP (Carbon Fiber Reinforced Plastic), or the like are exemplified. As the metal used for the head, one or more kinds of metals selected from pure titanium, a titanium alloy, stainless steel, maraging steel, an aluminium alloy, a magnesium alloy, and a tungsten-nickel alloy are exemplified. SUS630 and SUS304 are exemplified as stainless steel. As the specific example of stainless steel, CUSTOM450 (manufactured by CARPENTER TECHNOLOGY CORPORATION) is exemplified. As the titanium alloy, 6-4 titanium (Ti-6A1-4V), Ti-15V-3Cr-3Sn-3A1, or the like are exemplified. When the volume of the head is great, the hitting sound tends to be increased. The present invention is particularly effective in a head having a great hitting sound. In this respect, the material of the head is preferably the titanium alloy. In this respect, the materials of the sole and side are preferably the titanium alloy.

A method for manufacturing the head body is not restricted. Usually, a hollow head is manufactured by bonding two or more members. A method for manufacturing the head body is not restricted. As the method, casting, forging, and press forming are exemplified.

The structure of the head body is not restricted. Examples of the structures of the head bodies include a two-piece structure in which two members integrally formed respectively are bonded, a three-piece structure in which three members integrally formed respectively are bonded, and a four-piece structure in which four members integrally formed respectively are bonded. The head 2 has the four-piece structure.

EXAMPLES

Hereinafter, the effects of the present invention will be clarified by examples. However, the present invention should not be interpreted in a limited way based on the description of examples.

First, a valuation method will be described.

[Primary Natural Frequency]

The primary natural frequency was measured in a state of a single head body. A measuring method is as follows.

(a) An acceleration pickup is attached to a sole (sole outer surface) of a head.

(b) A thread is attached to a neck end face of the head, and the head is hung by the thread.

(c) The sole (sole outer surface) of the head is struck by an impact hammer having a force pickup.

(d) Data of an input shaking force F is obtained from the force pickup of the impact hammer.

(e) Response acceleration A is obtained from the acceleration pickup.

(f) "Moving mass=input shaking force F/response acceleration A" is calculated, and the frequency of the primary minimum value of the moving mass is defined as "primary natural frequency".

When the attaching position of the acceleration pickup in the item (a) is the position of a node of the primary vibration of the sole, the primary vibration (primary minimum value) does not appear in the item (f). Therefore, the measurement was performed with the acceleration pickup attached to some positions of the sole, and the position in which the primary vibration (primary minimum value) appeared was searched. Measurement results in attaching the acceleration pickup to the position in which the primary vibration (primary minimum value) appeared were adopted. A measuring machine in "an impact hammer method" described in Japanese Patent Application Laid-Open No. 2004-65570 can be used for measuring the primary natural frequency. For example, an adhesive is used for attaching the acceleration pickup to the sole.

[Hitting Sound Sensous Evaluation]

Nine golf players with a handicap of 10 to 20 hit golf balls using golf clubs and evaluated the golf clubs. The evaluation was performed on the basis of comparative example. The case where a hitting sound was better than that of comparative example was defined as two scorers. The case where the hitting sound was equivalent to that of comparative example was defined as one score. The case where the hitting sound was poorer than that of comparative example was defined as zero score. The average value of nine golf players' scales is shown in the following Table 1.

[Impact Sensous Evaluation]

Nine golf players with a handicap of 10 to 20 hit golf balls using golf clubs and evaluated the golf clubs. The evaluation was performed on the basis of comparative example. The case where impact was less than that of comparative example was defined as two scorers. The case where impact was equivalent to that of comparative example was defined as one score. The case where impact was greater than that of comparative example was defined as zero score. The average value of nine golf players' scales is shown in the following Table 1.

Example 1

Ahead having the same structure as that of a head 2 according to the first embodiment was produced. As described later, the number of partial weldings (partial weld ribs) was set to 8. As a material of a face member, "Ti-9" (trade name) manufactured by KOBE STEEL, LTD. was used. Ti-9 is a rolling material. The rolling material was pressed to obtain the face member. As a material of a crown member, "KS120" (trade name) manufactured by KOBE STEEL, LTD. was used. KS120 is a rolling material. The rolling material was pressed to obtain the crown member. As a material of a sole member, "KS120" (trade name) manufactured by KOBE STEEL, LTD. was used. KS120 is a rolling material. The rolling material was pressed to obtain the sole member. A round bar made of pure titanium was used as a material of a neck member. A hole was opened in the round bar by a drill to obtain the neck member having an approximately cylindrical shape.

A rib member as the partial weld rib was separately produced. A material of the rib member was made of a titanium alloy. Specifically, the material of the rib member was "KS120" manufactured by KOBE STEEL, LTD. The manufacturing method of the rib member was press processing.

Next, the rib member was welded to the sole member. The configuration of the welding is as described in the head 2. However, weldings were carried out at eight places. More specifically, the number of the partial weldings (weld beads Bd) was set to 8. The type of the welding was TIG welding. The angle θ1 was set to 0 degree. More specifically, the partial weld rib was set in parallel to the toe-heel direction.

Next, the sole member to which the rib member was welded, the face member, the crown member, and the neck member were welded to obtain a head before polishing. The type of the welding was plasma welding.

The outer surface of the head before polishing was polished to obtain a head of the example 1. The weight of the head was 190 g. The volume of the head was 460 cc. The real loft angle was 10 degrees. The other specifications are described in Table 1. Eight weld beads Bd were set at equal intervals of 15 mm. The distance c1 was constantly set to 15 mm. The distance S1 of the toe side was set to 6 mm, and the distance S1 of the heel side was also set to 6 mm. The height HR of the rib was constantly set to 4 mm over the entire longitudinal direction of the rib. The width BR of the rib (the thickness of the rib) was constantly set to 1 mm over the entire longitudinal direction of the rib.

A shaft and a grip were mounted to the head to obtain a golf club according to the example 1. The specification and the evaluation result of the example 1 are shown in the following Table 1.

Examples 2 to 5

A head and a golf club of each of examples were obtained in the same manner as in the example 1 except for the specification shown in Table 1. The specifications and the evaluation results of these examples are shown in the following Table 1. In the example 2, the distance c1 was made uneven. In the example 2, the distances c1 were set to 12 mm, 15 mm, 18 mm, 15 mm, 12 mm, 15 mm and 18 mm, in sequence to the heel side from the toe side.

Comparative Example

Figure 20:
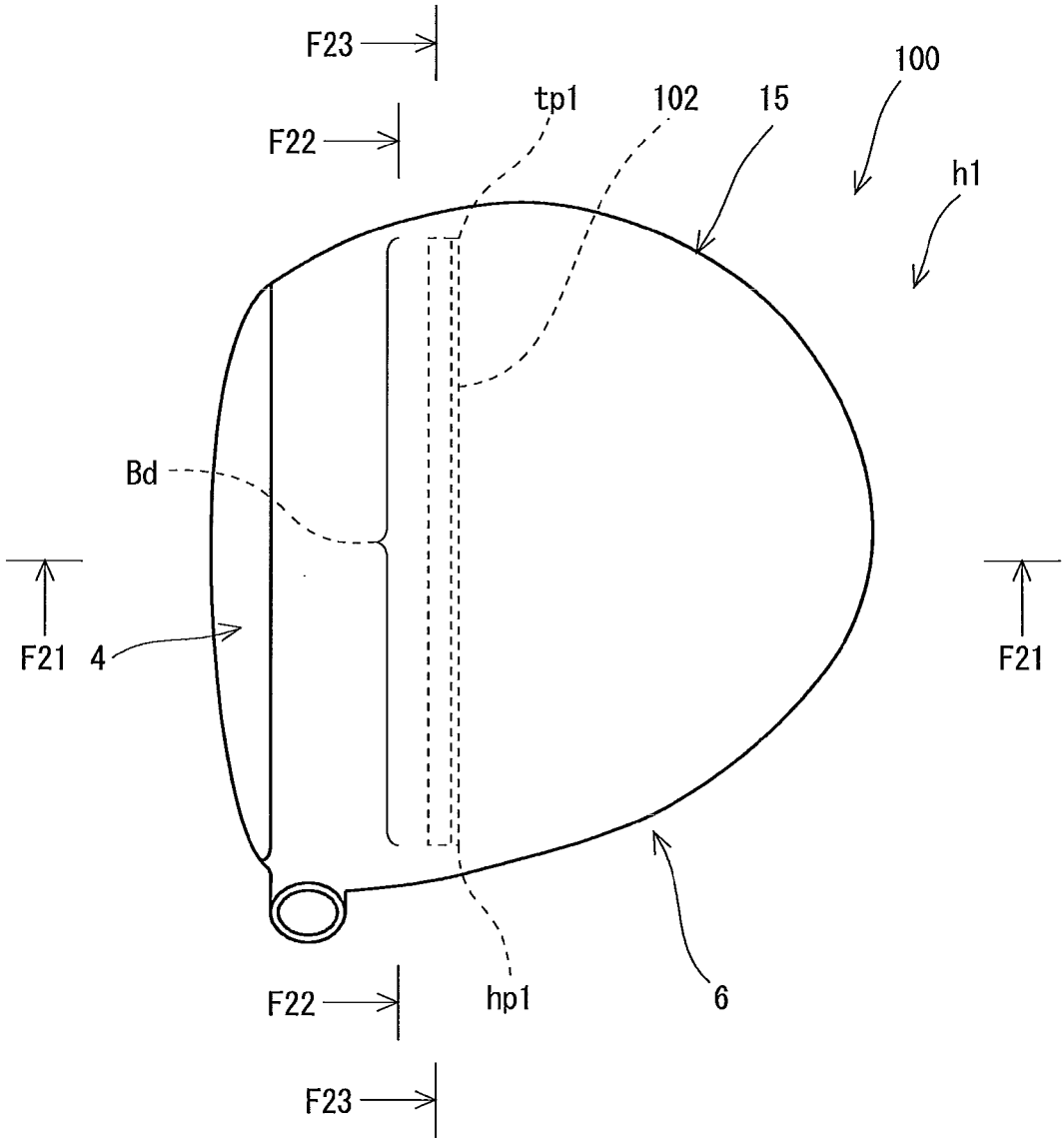
FIG. 20 is a plan view of a golf club head according to comparative example, as viewed from a crown side.
Figure 21:
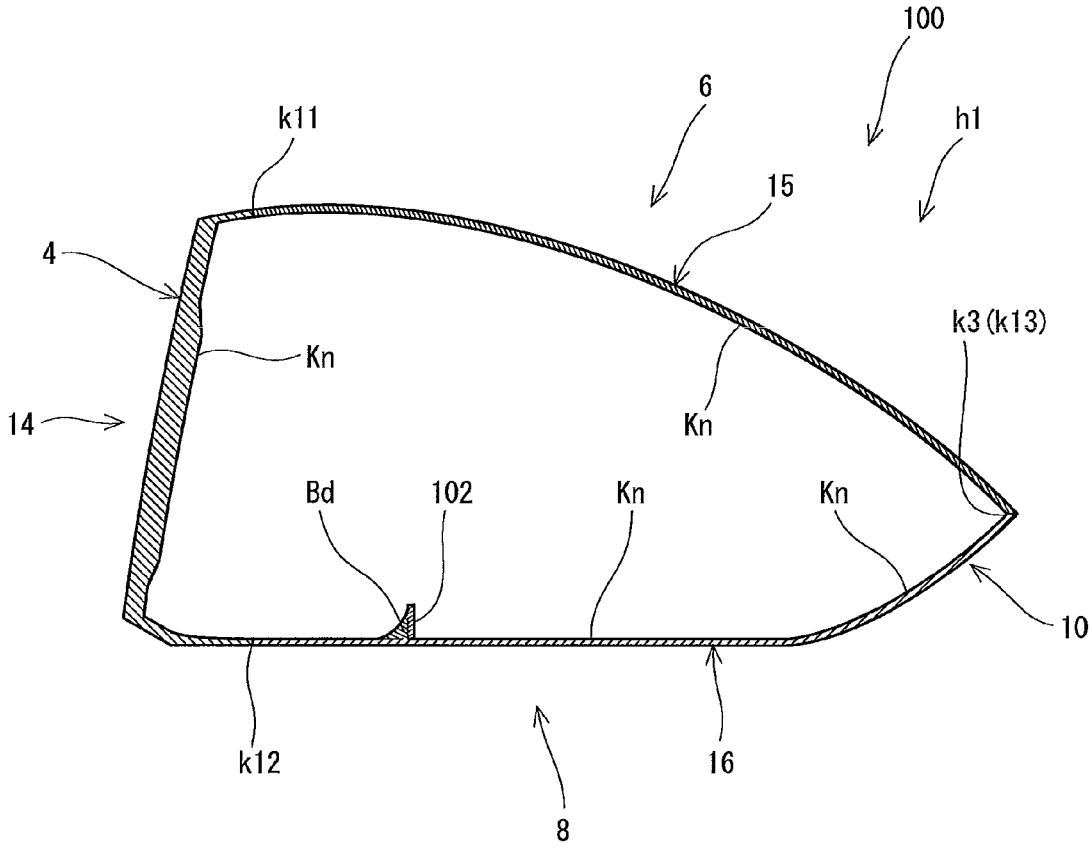
FIG. 21 is a sectional view taken along a line F21-F21 of FIG. 20.
Figure 22:
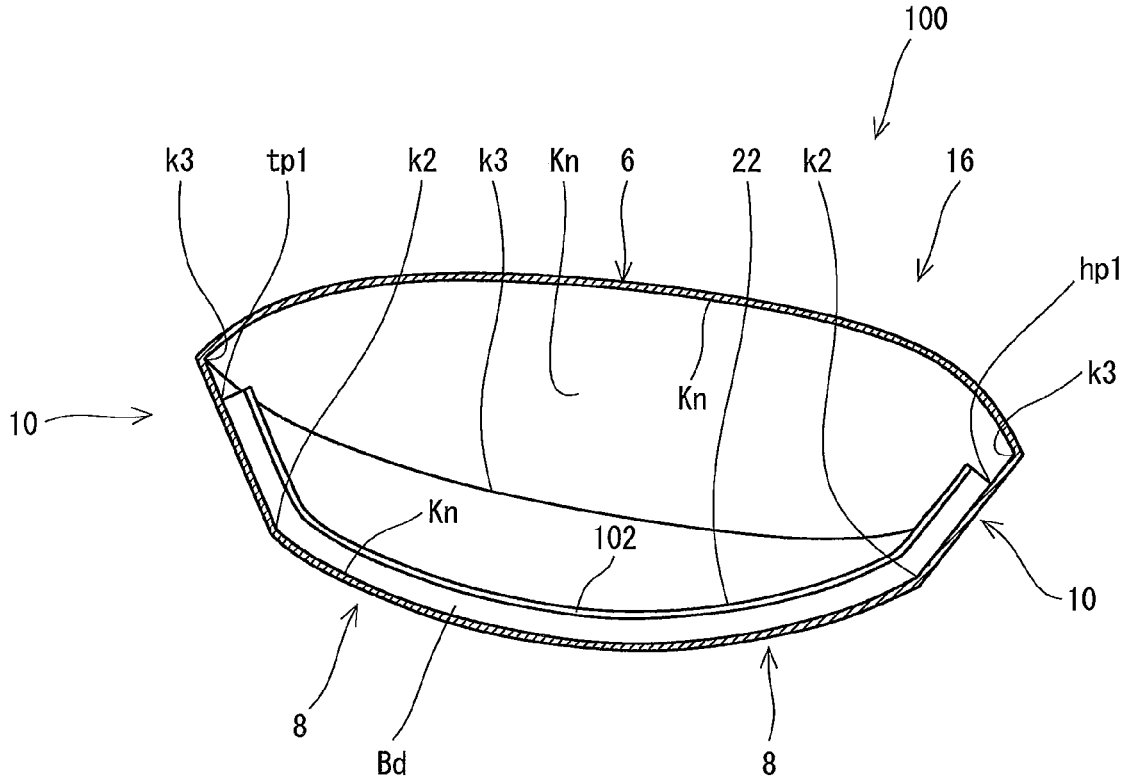
FIG. 22 is a sectional view taken along a line F22-F22 of FIG. 20.
Figure 23:
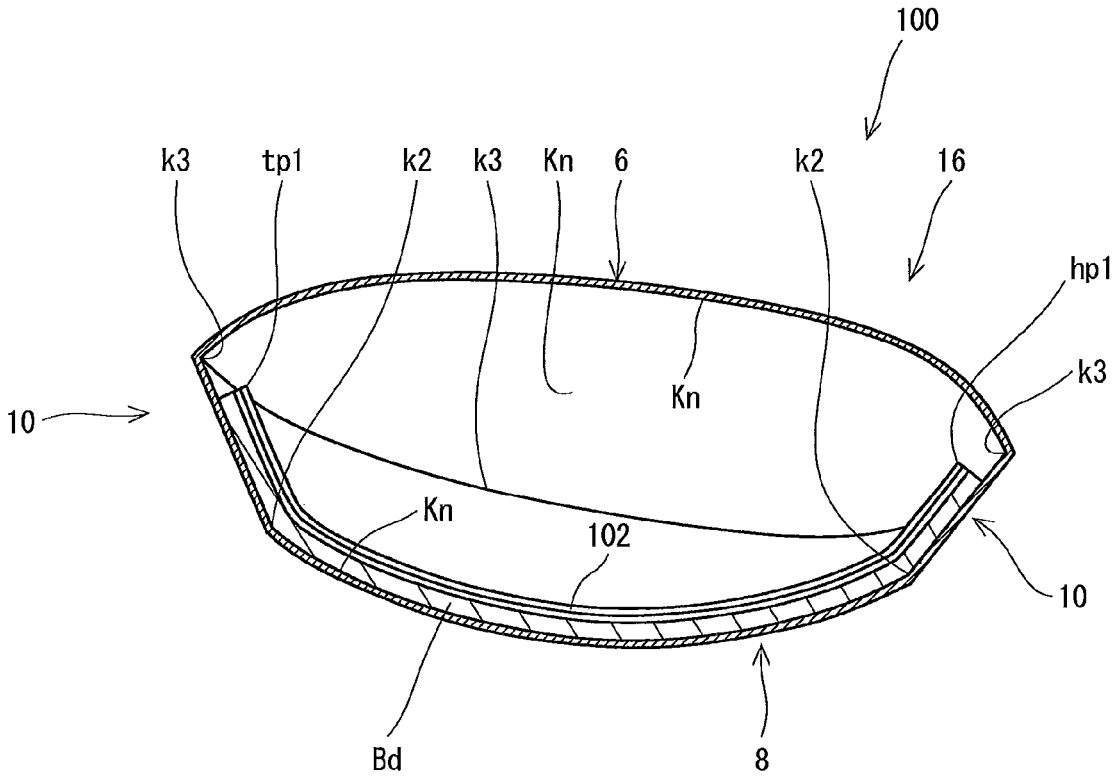
FIG. 23 is a sectional view taken along a line F23-F23 of FIG. 20.

A head 100 of comparative example is shown in FIGS. 20, 21, 22 and 23. FIG. 20 is a plan view of the head 100, as viewed from a crown side. FIG. 21 is a sectional view taken along a line F21-F21 of FIG. 20. FIG. 22 is a sectional view taken along a line F22-F22 of FIG. 20. FIG. 23 is a sectional view taken along a line F23-F23 of FIG. 20. The surface of a weld bead Bd appears to be flat and smooth in FIG. 22 or the like. However, in fact, the surface of the weld bead Bd has unevenness, and a large number of lines caused by the unevenness are observed.

Partial welding is not carried out in the comparative example. Welding is applied to the entire range of the longitudinal direction of the rib in the comparative example. The weld beads Bd of the comparative example are continuously provided linearly. The weld beads Bd are provided over the entire range of the longitudinal direction of a rib 102. The welding of the comparative example is provided on only the face side of the rib 102. The specification of the rib 102 is the same as that of the partial weld rib of the example. The specification and the evaluation result of the comparative example are shown in the following Table 1.

TABLE 1

Specifications and Evaluation Results of Examples and Comparative Example

| | Example 1 | Example 2 | Example 3 | Example 4 | Example 5 | Comparative Example |
|---|---|---|---|---|---|---|
| Rib height HR (mm) | 4 (Constant) | 4 (Constant) | 4 (Constant) | 4 (Constant) | 4 (Constant) | 4 (Constant) |
| Width Wa of head (mm) | 121 | 121 | 121 | 121 | 121 | 121 |
| Wb of the position of rib | 25 | 25 | 25 | 25 | 25 | 25 |

TABLE 1-continued

Specifications and Evaluation Results of Examples and Comparative Example

| | Example 1 | Example 2 | Example 3 | Example 4 | Example 5 | Comparative Example |
|---|---|---|---|---|---|---|
| Wb/Wa | 0.21 | 0.21 | 0.21 | 0.21 | 0.21 | 0.21 |
| Length Wc of head (mm) | 125 | 125 | 125 | 125 | 125 | 125 |
| Rib length Wr (mm) | 110 | 110 | 110 | 110 | 110 | 110 |
| Wr/Wc | 0.88 | 0.88 | 0.88 | 0.88 | 0.88 | 0.88 |
| Real length RL1 in rib root (mm) | 120 | 120 | 120 | 120 | 120 | 120 |
| Rib width BR (mm) | 1 (Constant) | 1 (Constant) | 1 (Constant) | 1 (Constant) | 1 (Constant) | 1 (Constant) |
| Number of partial weldings (Number of weld beads Bd) | 8 | 8 | 12 | 5 | 4 | Entire welding (Linear welding) |
| Distance c1 (mm) between partial weldings (In example 2, distances c1 are described in sequence from toe side. In other examples, distance c1 is constant.) | 15 | 12, 15, 18, 15,12, 15, 18 | 10 | 25 | 35 | |
| Distance S1 in rib end (mm) (distance S1 of the toe side is equal to distance S1 of heel side) | 6 | 6 | 3.5 | 8 | 6 | |
| T2/T1 | 0.8 | 0.8 | 0.8 | 0.8 | 0.8 | |
| Bead maximum width W1 (mm) (common in all weld beads) | 3 | 3 | 3 | 4 | 3 | |
| Length LB of bottom part of welding bead (mm) (common in all weld beads) | 3 | 3 | 3 | 4 | 4 | 3 |
| Height HB of weld bead (mm) (common in all weld beads) | 3 | 3 | 3 | 3 | 3 | 3 |
| Total value TW1 of bead maximum widths W1 (mm) | 24 | 24 | 36 | 20 | 12 | — |
| TW1/RL1 | 0.20 | 0.20 | 0.30 | 0.17 | 0.10 | |
| Weight Mh of entire head (g) | 191 | 191 | 191 | 191 | 190 | 194 |
| Primary natural frequency (Hz) | 3500 | 3500 | 3600 | 3500 | 3100 | 3600 |
| Hitting sound sensous evaluation | 1.0 | 1.1 | 1.0 | 1.0 | 0.9 | — |
| Impact sensous evaluation | 1.3 | 1.3 | 1.2 | 1.4 | 1.4 | — |

"Real length RL1 in rib root" shown in Table 1 is a length of the root portion of the rib. The length RL1 was measured along the longitudinal direction of the rib, and was measured along the extending direction of the rib root. Since a metal inner surface Kn of the rib root is curved in the examples and the comparative example, the length RL1 (mm) was also measured along the curved metal inner surface Kn. The length RL1 was set to 120 mm in all the examples and the comparative example.

A total value of bead maximum widths W1 is shown by TW1 in Table 1. The total value TW1 is calculated by multiplying the width W1 (mm) by the number of the weld beads Bd. In respect of enhancing the effect of the present invention, a ratio (TW1/RL1) is preferably equal to or less than 0.40, and more preferably equal to or less than 0.30. In respect of a weld strength, the ratio (TW1/RL1) is preferably equal to or greater than 0.05, and more preferably equal to or greater than 0.10.

As shown in Table 1, the examples have higher evaluation than that of the comparative example. Advantages of the present invention are clearly indicated by these results of evaluation.

The present invention is applicable to all types of golf clubs such as a wood type head, a utility type (hybrid type) head, or the like.

The description hereinabove is merely for an illustrative example, and various modifications can be made in the scope not to depart from the principles of the present invention.

What is claimed is:

1. A hollow golf club head comprising:

a face;

a sole; and a crown, wherein at least a part of an inner surface of the golf club head is a metal inner surface made of a metal;

at least one rib made of a metal is provided on the metal inner surface; the at least one rib is a partial weld rib obtained by carrying out partial welding between the at least one rib and the metal inner surface; and a welded portion and an unwelded portion coexist in a longitudinal direction of the partial weld rib between the metal inner surface and the partial weld rib;

wherein when a total value of a bead maximum width W1 of the partial welding is defined as TWI (mm), and a real length of a root of the rib is defined as RLI (mm), a ratio (TWI/RLI) is equal to or less than 0.40.

2. The golf club head according to claim 1, wherein the partial welding is carried out between a side surface of the partial weld rib and the metal inner surface; and the partial welding is carried out on only one side surface of both side surfaces of the partial weld rib.

3. The golf club head according to claim 1, wherein an extending direction of the partial weld rib is inclined or orthogonalized with respect to a face-back direction of the head; and the partial welding is carried out on only a side surface of a face side of both side surfaces of the partial weld rib.

4. The golf club head according to claim 1, wherein a weld bead is formed by the partial welding; and a rib height HR is equal to or greater than 2 mm, a height HB of the weld bead is equal to or greater than 2 mm, and a length LB of the weld bead is equal to or greater than 2 mm in at least one welded place.

5. The golf club head according to claim 4, wherein when a traverse width of an end part of the weld bead is defined as T1 (mm) and a minimum traverse width is defined as T2 (mm) in a section of a widthwise central surface PLc of the weld bead, a ratio (T2/T1) is 0.5 or greater and 0.95 or less.

6. The golf club head according to claim 1, wherein a plurality of partial weldings are carried out in the single partial weld rib; and a distance c1 between the adjacent partial weldings is 10 mm or greater and 25 mm or less.

7. The golf club head according to claim 1, wherein three or more partial weldings are carried out in the single partial weld rib; and a difference (Cmax−Cmin) between the maximum value Cmax (mm) and the minimum value Cmin (mm) of a distance c1 between the adjacent partial weldings is equal to or greater than 1 mm in the partial weld rib.

8. The golf club head according to claim 1, wherein the partial weld rib is curved.

9. The golf club head according to claim 1, wherein at least one of a toe side end and a heel side end of the partial weld rib extends to the crown.

10. The golf club head according to claim 9, wherein a length Lc of the partial weld rib on the crown is equal to or less than 10 mm.

11. The golf club head according to claim 1, further comprising a side, wherein a toe side and a heel side of the partial weld rib are terminated at the side.

12. The golf club head according to claim 1, wherein weld beads are formed by the partial welding;

the weld beads are present on a back side and a face side of the partial weld rib; and a position in a longitudinal direction of the rib of the weld bead of the face side is different from that of the weld bead of the back side in at least two weld beads of the weld beads.

13. The golf club head according to claim 1, further comprising a side, wherein the partial weld rib is present on only the inner surface of the sole, and is not present on the inner surface of the crown or the inner surface of the side.

14. The golf club head according to claim 1, wherein the number of the partial weld ribs is plural.

15. The golf club head according to claim 1, wherein the partial weld ribs and nonpartial weld ribs coexist, and when the number of the partial weld ribs is defined as N1 and the number of the nonpartial weld ribs is defined as N2, [N1/(N1+N2)] is equal to or greater than ½.

16. The golf club head according to claim 1, wherein the weld bead is formed by the partial welding;

a rib height HR of the partial weld rib is equal to or less than 8 mm;

a bead height HB of the weld bead is equal to or less than 8 mm; and a length LB of the weld bead is equal to or less 8 mm.

17. The golf club head according to claim 1, wherein a weight Mr of the partial weld rib is 1.0 g or greater and 5.0 g or less.

18. The golf club head according to claim 1, wherein a ratio (Mr/Mh) of a weight Mr of the partial weld rib to a weight Mh of the head is 0.008 or greater and 0.025 or less.

19. The golf club head according to claim 1, wherein an average value of a rib width BR of the partial weld rib is 0.5 mm or greater and 1.5 mm or less.

20. The golf club head according to claim 1, wherein a ratio (Wr/Wc) of a length Wr of the partial weld rib to a length Wc of the head is 0.80 or greater and 0.98 or less.

* * * * *